US011225076B2

(12) United States Patent
Aiba et al.

(10) Patent No.: US 11,225,076 B2
(45) Date of Patent: Jan. 18, 2022

(54) LIQUID DISCHARGE HEAD

(71) Applicant: Brother Kogyo Kabushiki Kaisha, Nagoya (JP)

(72) Inventors: Takashi Aiba, Nagoya (JP); Keiji Kura, Chita (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/833,850

(22) Filed: Mar. 30, 2020

(65) Prior Publication Data

US 2020/0324547 A1 Oct. 15, 2020

(30) Foreign Application Priority Data

Apr. 10, 2019 (JP) ..... JP2019-074937

(51) Int. Cl.
*B41J 2/14* (2006.01)

(52) U.S. Cl.
CPC ..... *B41J 2/14233* (2013.01); *B41J 2/14274* (2013.01); *B41J 2002/14258* (2013.01); *B41J 2002/14266* (2013.01); *B41J 2002/14306* (2013.01); *B41J 2002/14459* (2013.01); *B41J 2002/14491* (2013.01)

(58) Field of Classification Search
CPC ..... B41J 2/14233; B41J 2/14274; B41J 2002/14266; B41J 2002/14306; B41J 2002/14459; B41J 2002/14491; B41J 2002/14258
See application file for complete search history.

(56) References Cited

U.S. PATENT DOCUMENTS 7,157,837 B2 1/2007 Kojima
8,132,897 B2 * 3/2012 Kojima ..... B41J 2/14274 347/72
2004/0164651 A1 8/2004 Kojima

FOREIGN PATENT DOCUMENTS

JP 2004-259865 A 9/2004
JP 2011-212865 A 10/2011

* cited by examiner

*Primary Examiner* — Geoffrey S Mruk
(74) *Attorney, Agent, or Firm* — Banner & Witcoff, Ltd.

(57) ABSTRACT

A liquid discharge head includes: a piezoelectric body including piezoelectric layers stacked in a stacking direction, the piezoelectric body including a first end and a second end that are separated in a first direction orthogonal to the stacking direction of the piezoelectric layers; individual electrodes positioned in a first plane orthogonal to the stacking direction; a first common electrode formed in a second plane that is orthogonal to the stacking direction and of which position in the stacking direction is different from a position of a neutral plane of the piezoelectric body in the staking direction and a position of the first plane in the staking direction; and a trace positioned in a third plane of which position in the stacking direction is different from a position of the first plane, the position of the second plane, and the position of the neutral plane.

9 Claims, 14 Drawing Sheets

LIQUID DISCHARGE HEAD

CROSS REFERENCE TO RELATED APPLICATION

The present application claims priority from Japanese Patent Application No. 2019-074937 filed on Apr. 10, 2019, the disclosure of which is incorporated herein by reference in its entirety.

BACKGROUND

Field of the Invention

The present disclosure relates to a liquid discharge head configured to discharge a liquid, such as an ink, to a medium and a liquid discharge apparatus including the liquid discharge head.

Description of the Related Art

As a liquid discharge apparatus, there is known an ink-jet head of an ink-jet printer configured to form an image by discharging ink on a recording medium while performing relative movement with respect to the recording medium. For example, in a publicly known ink-jet printer, an ink-jet head including a piezoelectric body in which piezoelectric material layers (ceramics sheets) are stacked on top of each other is disclosed.

SUMMARY

In the publicly known ink-jet head, there is known that electrodes rows formed in the piezoelectric material layers cause warping deformation in the piezoelectric material layers when the piezoelectric material layers are calcined or baked. In the publicly known ink-jet head, dummy electrodes are formed on surfaces of the piezoelectric material layers to reduce the warping deformation caused in the piezoelectric body.

An object of the present disclosure is to propose another structure or configuration that is capable of reducing warping deformation that is caused in a piezoelectric body of an ink-jet head.

According to an aspect of the present disclosure, there is provided a liquid discharge head, including: a piezoelectric body including a plurality of piezoelectric layers stacked in a stacking direction, the piezoelectric body including a first end and a second end that are separated in a first direction, the first direction being orthogonal to the stacking direction of the piezoelectric layers; a plurality of individual electrodes positioned on a first plane orthogonal to the stacking direction; a first common electrode positioned on a second plane orthogonal to the stacking direction, a position of the second plane in the stacking direction being different from a position of the first plane in the staking direction and a position of a neutral plane of the piezoelectric body in the staking direction; and a trace positioned on a third plane, a position of the third plane in the stacking direction being different from the position of the first plane in the stacking direction, the position of the second plane in the stacking direction, and the position of the neutral plane in the stacking direction. The neutral plane is positioned between the first plane and the third plane in the stacking direction, and the second plane is positioned between the first plane and the third plane in the stacking direction. The piezoelectric body includes at least one through hole passing through from the second plane to the third plane. The individual electrodes is included in a plurality of individual electrode rows arranged between the first end and the second end with an interval therebetween. The individual electrode rows includes a first individual electrode row and a second individual electrode row that is adjacent to the first individual electrode row in the first direction, the first individual electrode row being positioned between the first end and the second individual electrode row in the first direction. The individual electrodes included in the first individual electrode row are arranged in a second direction orthogonal to the stacking direction and intersecting with the first direction. The first common electrode includes: a first extending portion extending, on the second plane, in the second direction to pass through a position between the first individual electrode row and the second individual electrode row in the first direction; and a plurality of first protrusions protruding, on the second plane, from the first extending portion toward the first end. Each of the first protrusions partially overlaps in the stacking direction with one of the individual electrodes belonging to the first individual electrode row. The first extending portion is electrically conducted with the trace through a conductive material placed inside the at least one through hole.

According to the above configuration, the first common electrode has the first extending portion and the first protrusions protruding from the first extending portion. The first extending portion and the first protrusions of the first common electrode are formed on the second plane, and the trace is formed on the third plane. The area of the metal film formed on the second plane can be smaller than a case in which the trace is formed on the second plane. Further, by forming the part of the second plane corresponding to the reduced area of the metal film, on the third plane that is at the opposite side of the first plane with the neutral plane interposed therebetween, the warping deformation in which the piezoelectric body is deformed to be convex toward the third plane can be reduced.

BRIEF DESCRIPTION OF THE DRAWINGS

FIGS. 4A and 4B are schematic cross-sectional views of the ink-jet head according to this embodiment, wherein FIG. 4A is a schematic cross-sectional view in a scanning direction and FIG. 4B is a schematic cross-sectional view in a conveyance direction.

DESCRIPTION OF THE EMBODIMENTS

<Schematic Configuration of Printer>

Figure 1:
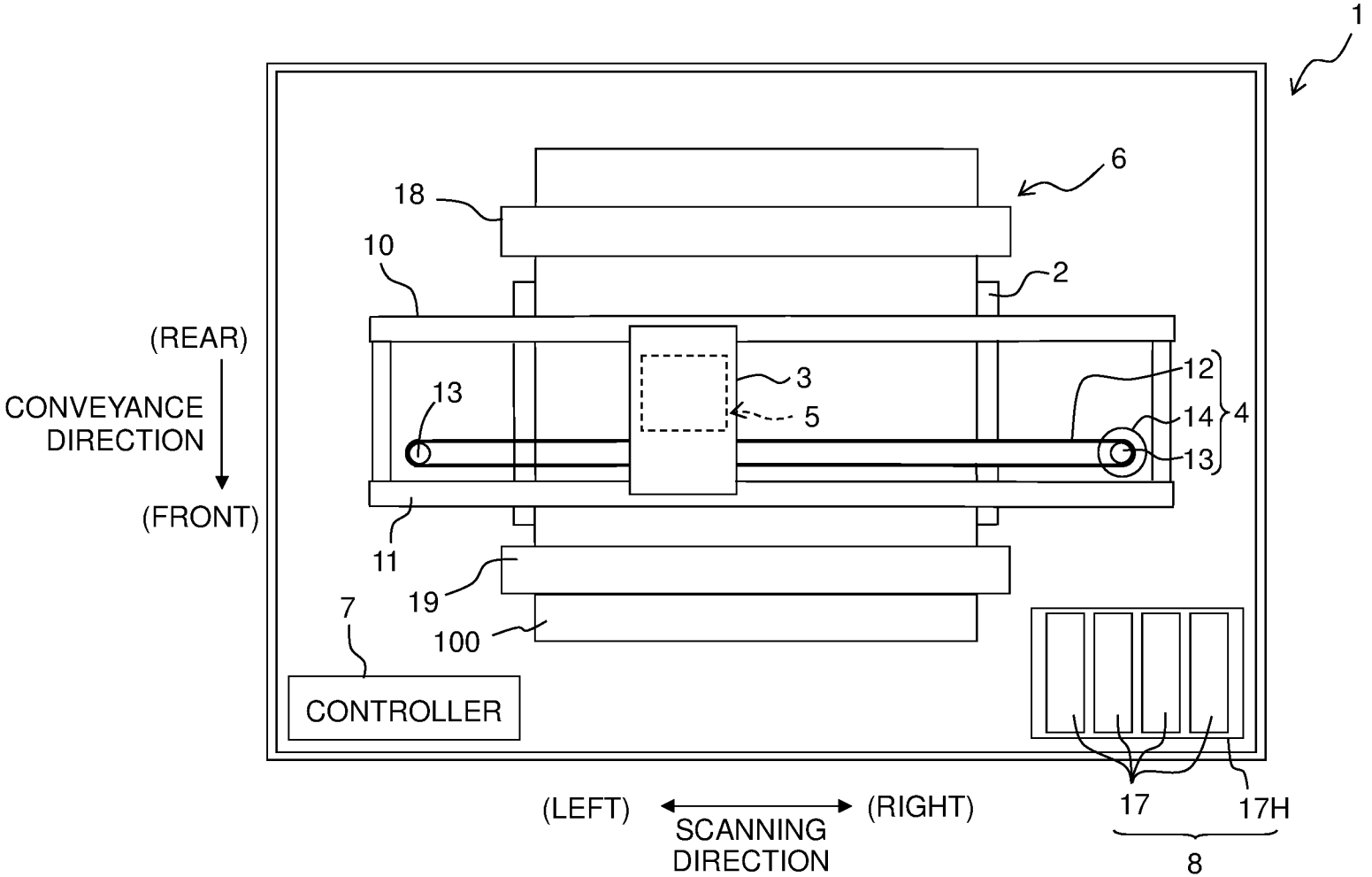
FIG. 1 is a plan view schematically depicting an ink-jet printer 1 according to this embodiment.

An embodiment of the present disclosure is explained below. As depicted in FIG. 1, an ink-jet printer 1 mainly includes a platen 2, a carriage 3, a carriage driving mechanism 4, an ink-jet head 5, a conveyer 6, a controller 7, and an ink supplying unit 8.

A recording sheet 100, which is a recording medium, is placed on an upper surface of the platen 2. The carriage 3 is configured to reciprocate by the carriage driving mechanism 4 in a left-right direction (hereinafter also referred to as a scanning direction) along two guide rails 10 and 11 in an area facing the platen 2. The carriage driving mechanism 4 includes a belt 12, two rollers 13 arranged to sandwich the platen 2 at both sides of the platen 2 in the scanning direction, and a carriage driving motor 14. The belt 12 is connected to the carriage 3. The belt 12 is stretched between the two rollers, 13 which are arranged apart from each other in the scanning direction, to form an oval ring that is long in the scanning direction when seen from above. As depicted in FIG. 1, the right roller 13 is coupled to a rotation shaft of the carriage driving motor 14. Rotating the carriage driving motor 14 causes the belt 12 to move around the two rollers 13. Accordingly, the carriage 3 coupled to the belt 12 can reciprocate in the scanning direction.

The ink-jet head 5 is attached to the carriage 3. The ink-jet head 5 reciprocates in the scanning direction together with the carriage 3. The ink supplying unit 8 includes: four ink cartridges 17, which respectively store four colors (black, yellow, cyan, and magenta) of inks; a cartridge holder 17H in which the four ink cartridges 17 are installed, and tubes (not depicted). The ink-jet head 5 is connected to the four ink cartridges 17 through the tubes (not depicted). This allows the inks of four colors to be supplied from the ink supplying unit 8 to the ink-jet head 5.

Figure 3:
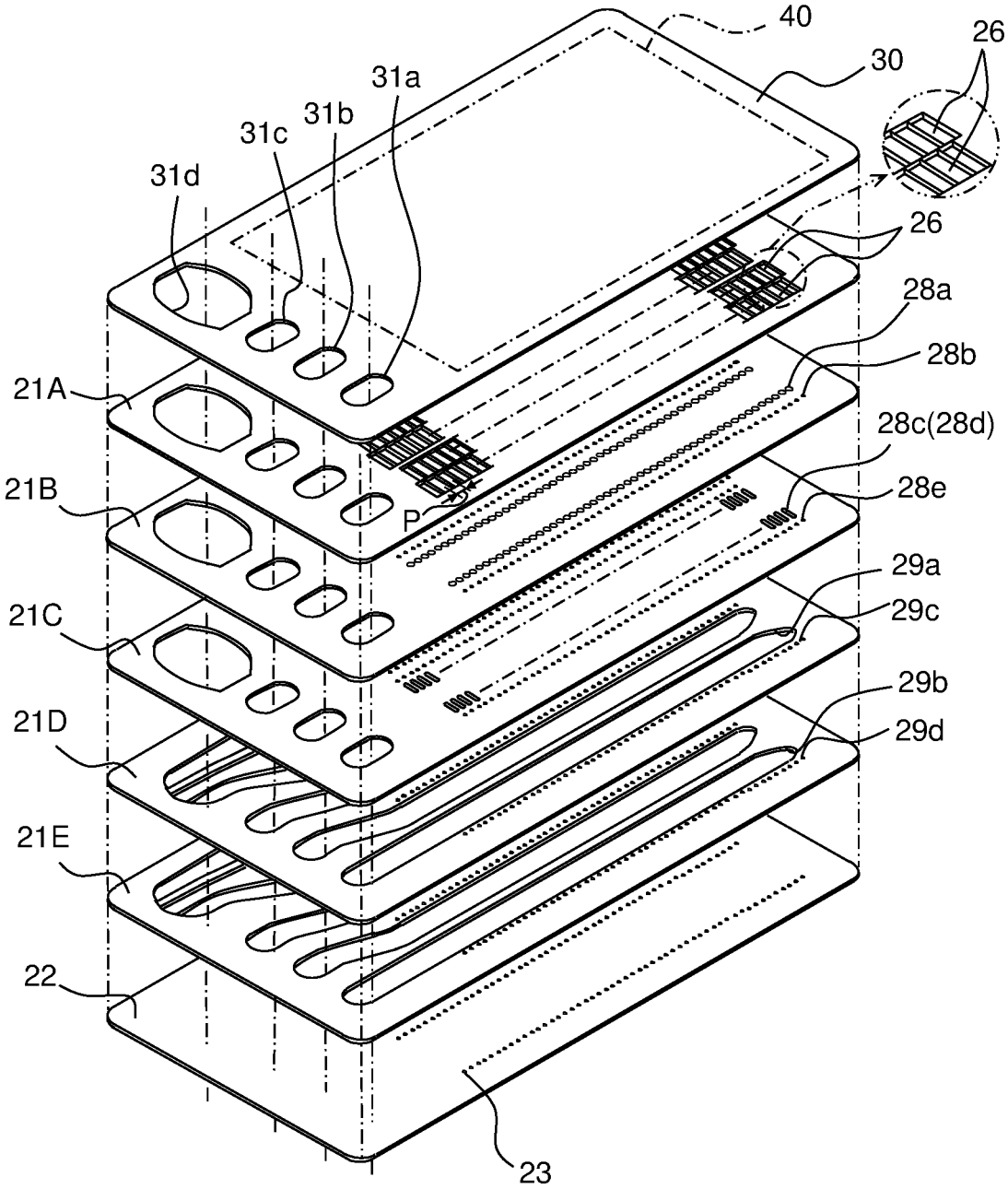
FIG. 3 is a schematic exploded view of a stacked body according to this embodiment.

A plurality of nozzles 23 are formed in a lower surface of the ink-jet head 5 (a back side of the page of FIG. 1, see FIG. 3). Ink supplied from each of the ink cartridges 17 is discharged from the nozzles 23 toward the recording sheet 100 placed on the platen 2.

The conveyer 6 has two conveying rollers 18 and 19 arranged to sandwich the platen 2 in a front-rear direction. The conveyer 6 conveys the recording sheet 100 placed on the platen 2 frontward (hereinafter also referred to as a conveyance direction) by the two conveying rollers 18 and 19.

The controller 7 includes a Read Only Memory (ROM), a Random Access Memory (RAM), an Application Specific Integrated Circuit (ASIC) including a control circuit, and the like. The controller 7 controls the ASIC to execute various types of processing such as printing on the recording sheet 100 in accordance with programs stored in the ROM. For example, in the printing processing, the controller 7 controls the ink-jet head 5, the carriage driving motor 14, and the like on the basis of a printing instruction input from an external apparatus such as a personal computer (PC) to perform the printing of an image on the recording sheet 100. Specifically, the controller 7 alternately performs an ink discharge operation and a conveyance operation. In the ink discharge operation, ink is discharged during movement of the ink-jet head 5 in the scanning direction together with the carriage 3. In the conveying operation, the recording sheet 100 is conveyed in the conveyance direction by a predefined amount by use of the conveying roller 18 and 19.

Figure 2:
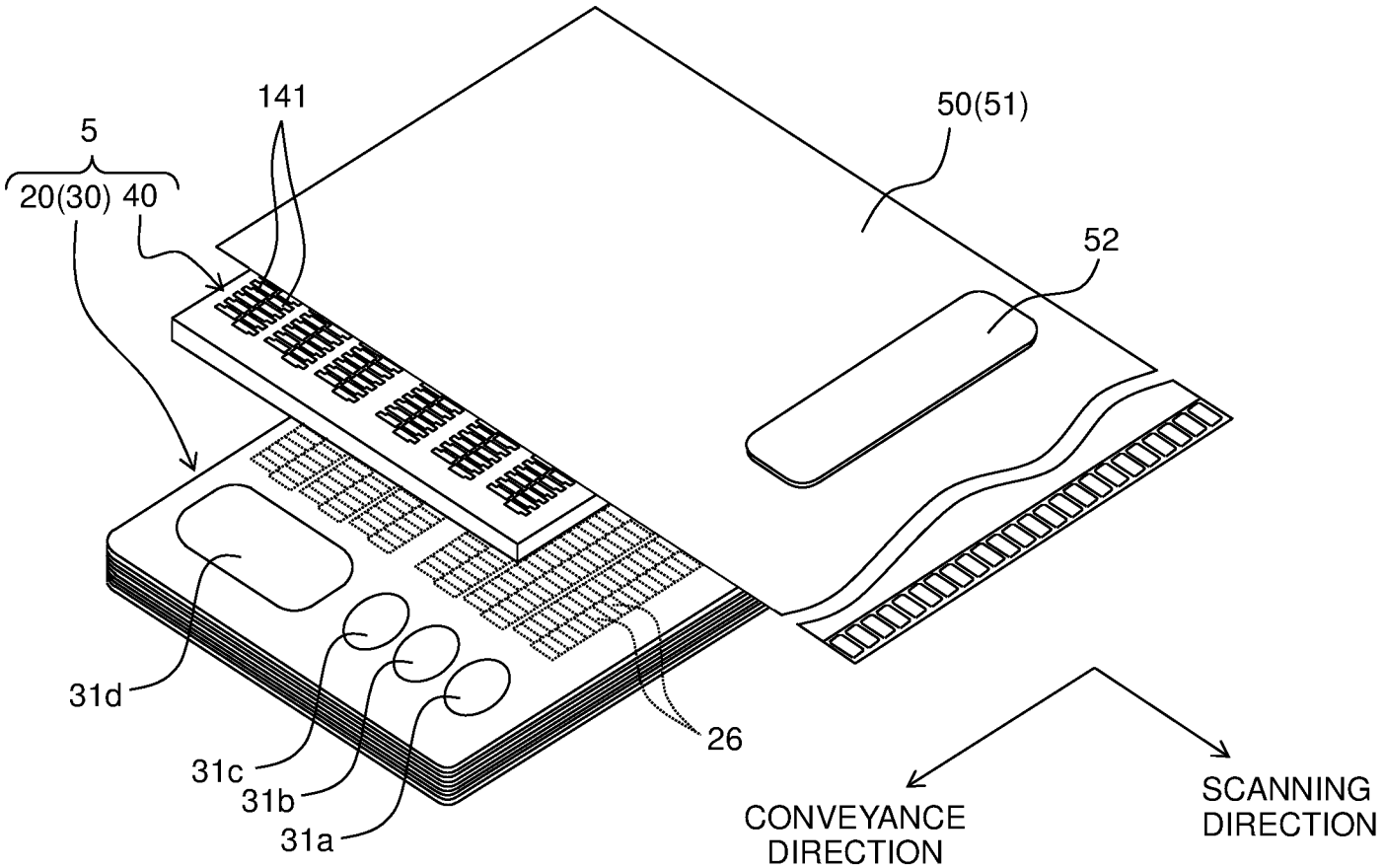
FIG. 2 schematically depicts an ink-jet head 5 and a trace member 50 according to this embodiment.

The ink-jet head 5 mainly includes a channel unit 20, a vibration plate 30, a piezoelectric body 40, and a trace member 50 (see FIG. 2). The Channel unit 20 includes five metal plates 21A to 21E and a nozzle plate 22, as depicted in FIGS. 2 and 3. The vibration plate 30 is joined to the metal plate 21A of the channel unit 20. In the following explanation, the combination of the channel unit 20 and the vibration plate 30 is referred to as a stacked body 60. Namely, as depicted in FIG. 3, the stacked body 60 includes the vibration plate 30, the five metal plates 21A to 21E, and the nozzle plate 22. In the stacked body 60, these plates are stacked on top of each other and joined to each other in that order from the top. In the following explanation, a direction in which these plates are stacked on top of each other in the stacked body 60 is referred to as a stacking direction.

The vibration plate 30, which is a metal plate having a substantially rectangular shape, is long in the conveyance direction. The metal plates 21A to 21E and the nozzle plate 22 have a substantially rectangular shape of which plan view is similar to the vibration plate 30. As depicted in FIGS. 2 and 3, four opening 31*a* to 31*d*, which serve as ink supply ports for supplying inks to manifolds described below, are formed in an end in the conveyance direction of the vibration plate 30. The four opening 31*a* to 31*d* are arranged side by side in the scanning direction (left-right direction). The opening 31*a* is an ink supply port for yellow ink, the opening 31*b* is an ink supply port for magenta ink, the opening 31*c* is an ink supply port for cyan ink, and the opening 31*d* is an ink supply port for black ink. Three manifolds are provided for black ink, and the opening 31*d* is a supply port for supplying black ink to the three manifolds. On the other hand, one manifold is provided for each of the color inks (cyan, magenta, and yellow inks), and each of color inks is supplied to the corresponding one of manifolds via the corresponding one of the openings 31*a* to 31*c*. An area of the opening 31*d* is thus larger than an area of each of the openings 31*a* to 31*c*.

The plate 21A is a metal plate in which openings functioning as pressure chambers 26 are formed regularly. Further, openings are formed at positions overlapping with the four openings 31*a* to 31*d* of the vibration plate 30. The pressure chambers 26 are arranged in the conveyance direction at an arrangement pitch P to form a pressure chamber row 25, and twelve pressure chamber rows 25 are formed in the plate 21A. The twelve pressure chamber rows 25 are arranged side by side in the scanning direction (left-right direction).

Of the twelve pressure chamber rows 25, six pressure chamber rows 25 are pressure chamber rows 25 for color inks, and the remaining six pressure chamber rows 25 are pressure chamber rows 25 for black ink. As depicted in FIG. 2, the six pressure chamber rows 25 for black ink are arranged side by side with respect to the opening 31*d* in the conveyance direction. The six pressure chamber rows 25 for color inks include two pressure chamber rows 25 for cyan ink, two pressure chamber rows 25 for magenta ink, and two pressure chamber rows 25 for yellow ink. The two pressure chamber rows 25 for cyan ink are arranged side by side with respect to the opening 31*c* in the conveyance direction. The two pressure chamber rows 25 for magenta ink are arranged side by side with respect to the opening 31*b* in the conveyance direction. The two pressure chamber rows 25 for yellow ink are arranged side by side with respect to the opening 31*a* in the conveyance direction.

Between the two pressure chamber rows 25 for cyan ink, the pressure chambers 26 are positioned to be shifted with respect to one another in the conveyance direction by half the arrangement pitch P (P/2) of the respective pressure chamber rows 25. This similarly applies also to the two pressure chamber rows 25 for magenta ink, and to the two pressure chamber rows 25 for yellow ink. The six pressure chamber rows 25 for black ink have three sets of two pressure chamber rows 25 (a pair of pressure chamber rows 25) in which the pressure chambers 26 are positioned to be shifted with respect to one another in the conveyance direction by half the arrangement pitch P (P/2) of the respective pressure chamber rows 25. Although not depicted clearly in FIG. 2, the pairs of pressure chamber rows 25 belonging to the three sets of pressure chamber rows 25 are positioned to be shifted with respect to one another in the conveyance direction by one-third (⅓) of the arrangement pitch P. Thus, as a whole, the positions of the pressure chambers 26 in the conveyance direction belonging to the six pressure chamber rows 25 are shifted with respect to one another by ⅙ of the arrangement pitch P of the respective pressure chamber rows 25.

The plate 21B has communication holes 28*a* that form channels laid from manifolds 27 (common ink chambers) described below to the respective pressure chambers 26, and communication holes 28*b* that form channels laid from the respective pressure chambers 26 to respective nozzles 23 described below. In an upper surface of the plate 21C, communication holes 28*c* are formed as recesses for communications between the pressure chambers 26 and the manifolds 27. Further, the plate 21C has communication holes 28*d* that form channels laid from the manifolds 27 to the pressure chambers 26, and communication holes 28*e* that form channels laid from the pressure chambers 26 to the nozzles 23. Further, openings are formed in each of the plates 21B and 21C, at positions or locations thereof at which the openings overlap respectively with the four openings 31*a* to 31*d* of the vibration plate 30. Further, the plates 21D and 21E have communication holes 29*a* and 29*b* that form the manifolds 27, and communication holes 29*c* and 29*d* that form channels laid from the pressure chambers 26 to the nozzles 23.

The nozzle plate 22 is made from a synthetic resin (for example, polyimide resin) wherein the nozzles 23 are formed to correspond respectively to the pressure chambers 26 formed in the plate 21A.

Figure 4A:
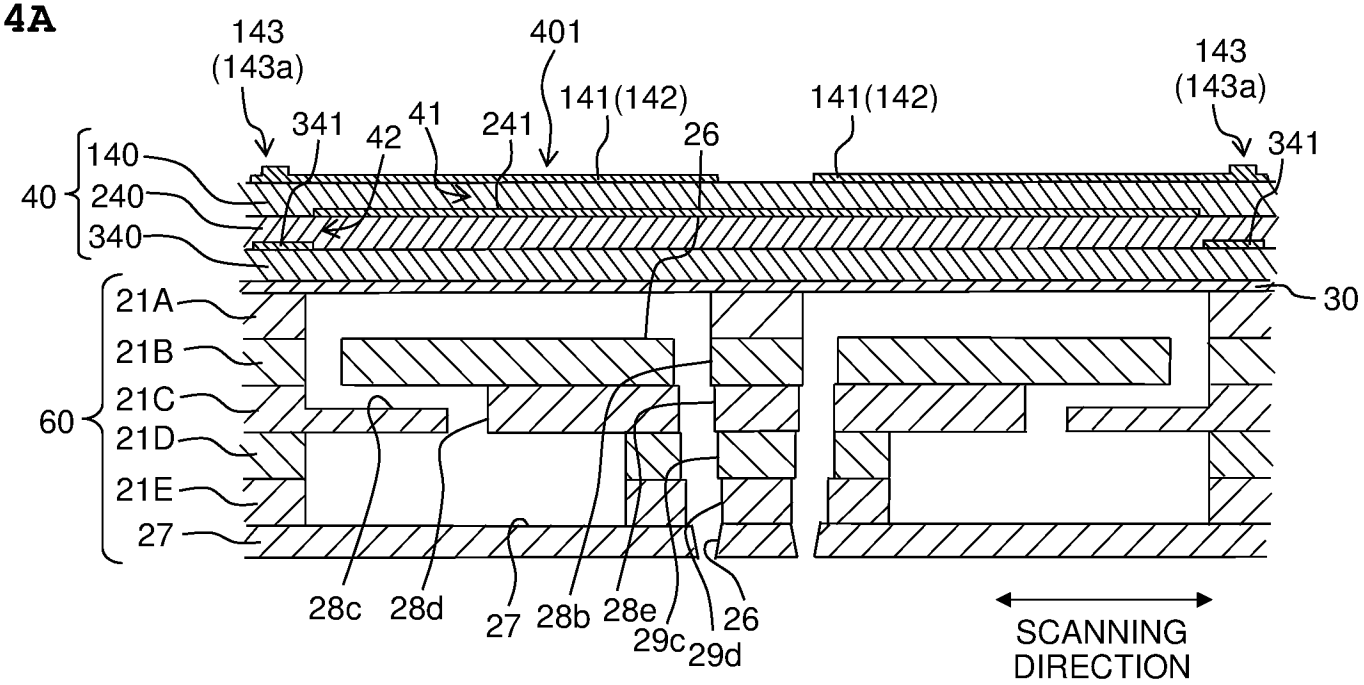
Figure 4B:
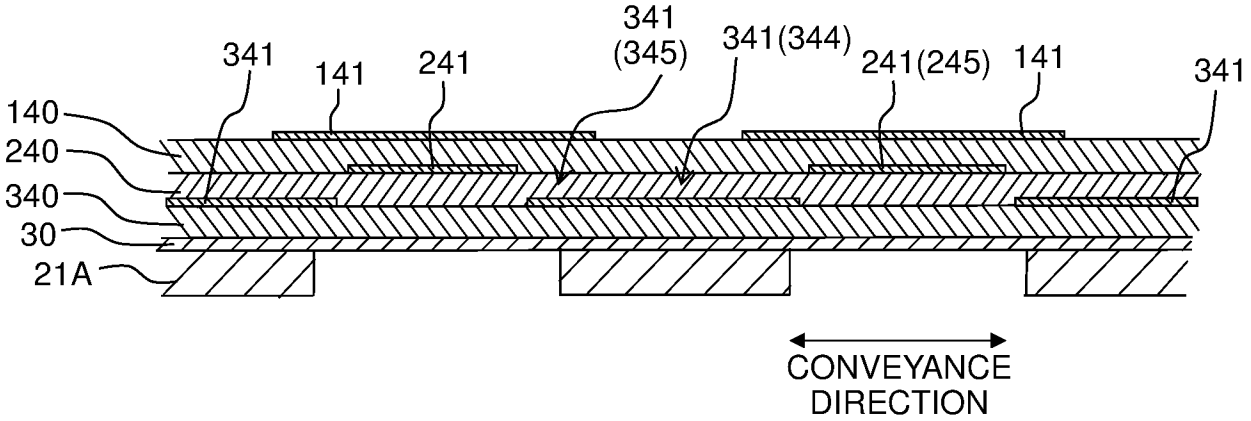

By stacking and joining the vibration plate 30, the plates 21A to 21E, and the nozzle plate 22, channels from the manifolds to the nozzles 23 via the pressure chambers 26 are formed as depicted in FIGS. 4A and 4B. At the same time, ink supply channels for supplying the inks to the manifolds 27 are also formed.

Since the vibration plate 30 and the plates 21A to 21E are metal plates, it is possible to join the above-mentioned plates by means of metallic diffusion bonding or junction. Further, since the nozzle plate 22 is made from resin, the nozzle plate 22 is joined to the plate 21E with an adhesive or the like, but not by the metallic diffusion junction. Note that the nozzle plate 22 may be a metal plate; in such a case, it is possible to join the nozzle plate 22 with the plates 30 and 21A to 21E in the same manner, namely by means of metallic diffusion junction, as the joining of the plates 30 and 21A to 21E. Alternatively, all the plates may be joined with an adhesive, or the like.

<Piezoelectric Body 40>

For example, as depicted in FIGS. 2 and 3, the piezoelectric body 40 is arranged on the vibration plate 30. The piezoelectric body 40 has an approximately rectangular planar shape. As depicted in FIGS. 4A and 4B, the piezoelectric body 40 is formed having a plurality of piezoelectric elements 401. The piezoelectric elements 401 are provided to correspond respectively to the pressure chambers 26. Each of the piezoelectric elements 401 cooperates with the vibration plate 30 to change the volume of the corresponding one of the pressure chambers 26. With this, each of the piezoelectric elements 401 cooperates with the vibration plate 30 to apply pressure to the ink in the corresponding one of the pressure chambers 26, thereby providing ink with energy for discharging ink from the nozzle 23 communicating with the corresponding one of the pressure chambers 26.

A configuration of the piezoelectric body 40 is explained below. As depicted in FIGS. 4A and 4B, the piezoelectric body 40 has three piezoelectric layers (upper piezoelectric layer 140, intermediate piezoelectric layer 240, and lower piezoelectric layer 340), individual electrodes (upper electrodes) 141, intermediate common electrodes (intermediate electrodes) 241, and a lower common electrode (lower electrode) 341. The lower piezoelectric layer 340, the intermediate piezoelectric layer 240 and the upper piezoelectric layer 140 are stacked on the vibration plate 30 in that order. The three piezoelectric layers 140, 240, and 340 are made using a piezoelectric material composed primarily of lead zirconate titanate (PZT), which is a mixed crystal of lead titanate and lead zirconate. Alternatively, the three piezoelectric layers 140, 240, and 340 may be made using a non-lead based piezoelectric material that does not contain lead. The lower common electrode 341 is arranged on an upper surface of the lower piezoelectric layer 340, the intermediate common electrodes 241 are arranged on an upper surface of the intermediate piezoelectric layer 240, and the individual electrodes 141 are arranged on an upper surface of the upper piezoelectric layer 140.

In the following, both ends in the scanning direction of the upper piezoelectric layer 140 are referred to as ends 140L and 140R, and both ends in the conveyance direction of the upper piezoelectric layer 140 are referred to as ends 140U and 140D (see FIG. 5). Both ends in the scanning direction of the intermediate piezoelectric layer 240 are referred to as ends 240L and 240R, while both ends in the conveyance direction of the intermediate piezoelectric layer 240 are referred to as ends 240U and 240D (see FIG. 6). Both ends in the scanning direction of the lower piezoelectric layer 340 are referred to as ends 340L and 340R, and both ends in the conveyance direction of the lower piezoelectric layer 340 are referred to as ends 340U and 340D (see FIG. 7).

Figure 5:
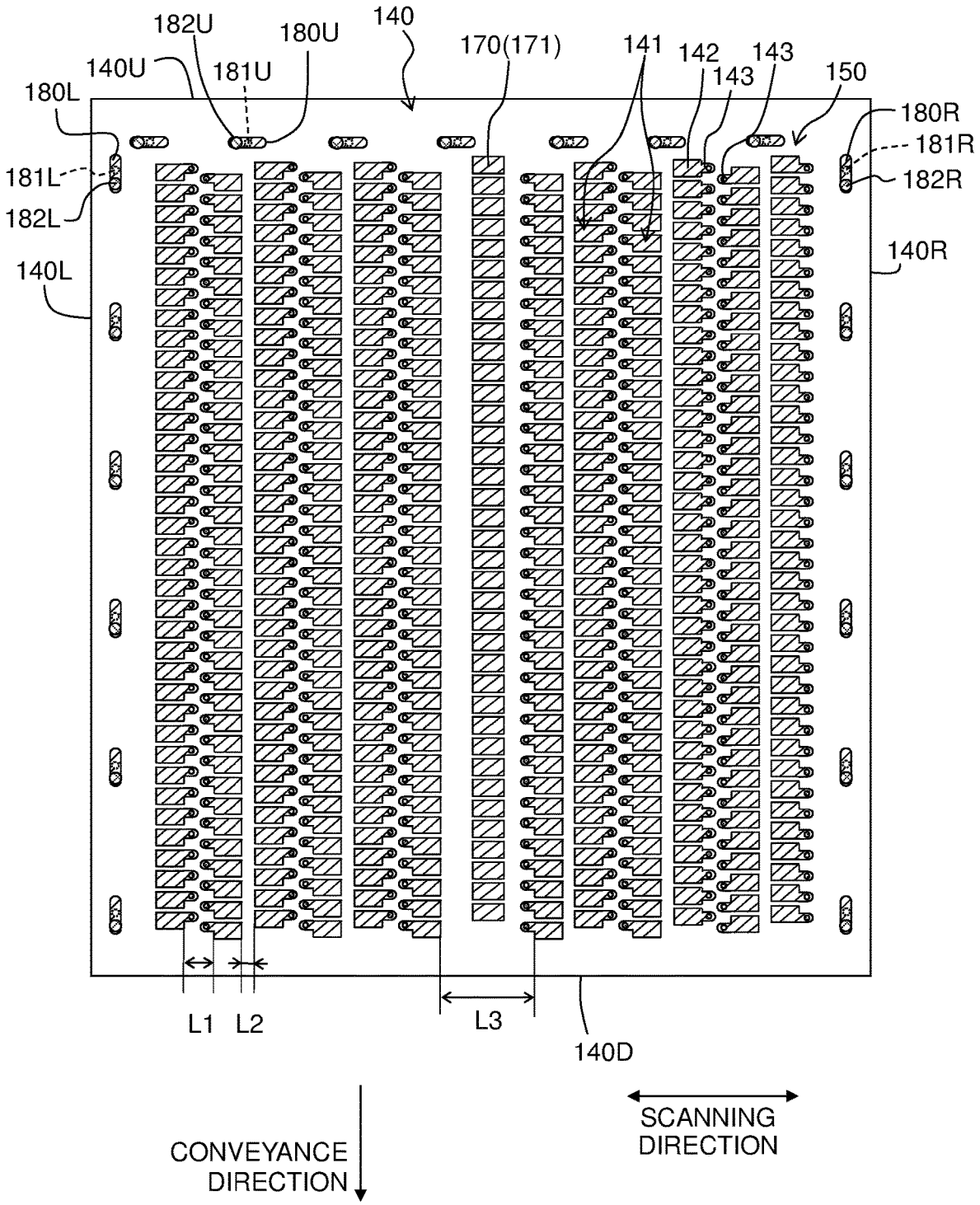
FIG. 5 is a top view of an upper piezoelectric layer 140 according to this embodiment.

As depicted in FIG. 5, the end 140L in the scanning direction of the upper piezoelectric layer 140 is formed having six conductor films 180L arranged in a row in the conveyance direction. Each conductor film 180L has a through hole 181L and a terminal 182L. The inside of the through hole 181L is filled with the same conductive material as a conductive material forming the conductor film 180L. The end 140U in the conveyance direction of the upper piezoelectric layer 140 is formed having seven conductor films 180U arranged in a row in the scanning direction. Each conductor film 180U has a through hole 181U and a terminal 182U. The through holes 181U of the seven conductor films 180U are arranged to overlap in the stacking direction with ends in the conveyance direction of seven extending portions 244 of the intermediate common electrodes 241 described below. The inside of the through hole 181U is filled with the same conductive material as a conductive material forming the conductor film 180U. The conductors in the through holes 181L and 181U are electrically conducted with the intermediate common electrodes 241 (see FIG. 6) formed on the upper surface of intermediate piezoelectric layer 240 and the conductor film 350 (see FIG. 7) formed on the upper surface of the lower piezoelectric layer 340, as described below. The terminals 182L and 182U are connected to terminals (not depicted) of an FPC 51 described below. The terminals 182L and 182U function as terminals for supplying a predefined potential (e.g., 24V) from the driver IC 52 to the intermediate common electrodes 241 through the FPC 51.

The end 140R in the scanning direction of the upper piezoelectric layer 140 is formed having six conductor films 180R arranged in a row in the conveyance direction. Each conductor film 180R has a through hole 181R and a terminal 182R. The inside of the through hole 181R is filled with the same conductive material as a conductive material forming the conductor film 180R. The conductors filled in the through holes 181R are electrically conducted with the lower common electrode 341 (see FIG. 7) through the conductors filled in through holes 281R (see FIG. 6) described below. The terminals 182R are connected to the terminals (not depicted) of the FPC 51 described below. The terminals 182R function as terminals for supplying a predefined potential (e.g., 0V) from the driver IC 52 to the lower common electrode 341 through the FPC 51.

<Individual Electrodes 141>

As depicted in FIGS. 4A and 4B, the individual electrodes 141 are formed in the upper surface of the upper piezoelectric layer 140 at positions that correspond respectively to the pressure chambers 26. The individual electrodes 141 are formed, for example, from platinum (Pt), iridium (Ir), or the like. As depicted in FIG. 5, twelve individual electrode rows 150 are formed to correspond to the twelve pressure chamber rows 25. The twelve individual electrode rows 150 are arranged side by side in the scanning direction. Each of the individual electrode rows 150 includes 37 pieces of the individual electrode 141 arranged in the conveyance direction at a predefined pitch P. Of the twelve individual electrode rows 150, the first and second individual electrode rows 150, the third and fourth individual electrode rows 150, the fifth and sixth individual electrode rows 150, the seventh and eighth individual electrode rows 150, the ninth and tenth individual electrode rows 150, and the eleventh and twelfth individual electrode rows 150 each form a pair of individual electrode rows, numbered from the individual electrode row 150 closest to the end 140L of the upper piezoelectric layer 140 in the scanning direction (left-right direction). In the following explanation, an individual electrode row 150 that is included in the twelve individual electrode rows 150 and that is located in a n-th location in the scanning direction numbered from another individual electrode row 150 that is the closest, in the scanning direction, to the end 140L of the upper piezoelectric layer 140 is referred to simply as a "n-th" individual electrode row 150 from the left. This is similarly applicable also regarding the intermediate piezoelectric layer 240 and the lower piezoelectric layer 340; a certain portion that is included in portions and that is located in a n-th location in the scanning direction numbered from another portion that is the closest, in the scanning direction, to the end 240L (see FIG. 6) of the intermediate piezoelectric layer 240, or the end 340L (see FIG. 7A) of the lower piezoelectric layer 340 is referred to simply as a "n-th" portion from the left. In each pair of the individual electrode rows 150, the individual electrodes 141 are positioned (arranged) to be shifted from each other in the conveyance direction by half the arrangement pitch P (P/2) of the respective individual electrode rows 150. Further, the pair of the seventh and eighth individual electrode rows 150, the pair of the ninth and tenth individual electrode rows 150, and the pair of the eleventh and twelfth individual electrode rows 150 from the left are positioned (arranged) to be shifted from each other in the conveyance direction by ⅓ the arrangement pitch P. Therefore, in the seventh and eighth individual electrode rows 150, the ninth and tenth individual electrode rows 150, and the eleventh and twelfth individual electrode rows 150 from the left, the individual electrodes 141 are positioned (arranged) to be shifted from each other in the conveyance direction by ⅙ the arrangement pitch P of the respective individual electrode rows 150.

Among the twelve individual electrode rows 150, first six pairs of the individual electrode rows 150 from the left, namely the pair of the first and second, the pair of third and fourth, and the pair of fifth and sixth individual electrode rows 150 from the left correspond respectively to the pressure chamber rows 25 for cyan ink, the pressure chamber rows 25 for magenta ink, and the pressure chamber rows 25 for yellow ink. Further, another six pairs of the individual electrode rows 150 from the left, namely the pair of the seventh and eighth, the pair of ninth and tenth, and the pair of eleventh and twelfth individual electrode rows 150 from the left correspond to the pressure chamber rows 25 for black ink.

Each of the individual electrodes 141 has a wide-width portion 142 having a rectangular planar shape, and a narrow-width portion 143 extending from the wide-width portion 142 leftward or rightward in the left-right direction (scanning direction). Each of the narrow-width portions 143 is formed having a bump 143*a* that is to be joined electrically with a contact point (not depicted) provided in the FPC 51 of the trace member 50 described below. As depicted in FIG. 5, in the individual electrodes 141 forming the first, third, fifth, eighth, tenth, and twelfth individual electrode rows 150 from the left among the twelve individual electrode rows 150, the narrow-width portions 143 extend in the scanning direction respectively from ends 142R, of the wide-width portions 142, in the scanning direction toward the end 140R of the upper piezoelectric layer 140. In the individual electrodes 141 forming the second, fourth, sixth, seventh, ninth and eleventh individual electrode rows 150 from the left among the twelve individual electrode rows 150, the narrow-width portions 143 extend in the scanning direction respectively from ends 142L, of the wide-width portions 142, in the scanning direction toward the end 140L of the upper piezoelectric layer 140. Note that each of the narrow-width portions 143 extends in the scanning direction, at the side opposite to (the far side from) the nozzle formed in the corresponding one of the pressure chambers 26 (see FIG. 4A). That is, in the pressure chambers 26 forming the first, third, fifth, eighth, tenth, and twelfth pressure chamber rows 25 from the left, the nozzles 23 of the respective pressure chambers 26 are formed in positions closer to the end 140L of the upper piezoelectric layer 140, than to a center portion in the scanning direction of each of the pressure chambers 26. In the pressure chambers 26 forming the second, fourth, sixth, seventh, ninth and eleventh pressure chamber rows 25 from the left, the nozzles 23 of the respective pressure chambers 26 are formed in positions closer to the end 140R of the upper piezoelectric layer 140, than to the center portion in the scanning direction of each of the pressure chambers 26.

Among the individual electrode rows 150 adjacent to each other in the scanning direction, (1) the first individual electrode row 150 and the second individual electrode row 150 from the left; (2) the third individual electrode row 150 and the fourth individual electrode row 150 from the left; (3) the fifth individual electrode row 150 and the sixth individual electrode row 150 from the left; (4) the eighth individual electrode row 150 and the ninth individual electrode row 150 from the left; and (5) the tenth individual electrode row 150 and the eleventh individual electrode row 150 from the left, are arranged such that the narrow-width portions 143 of the individual electrodes 141 forming the individual electrode rows 150 respectively face each other in the scanning direction. Therefore, an interval (L1) in the scanning direction between the wide-width portions 142 of the individual electrodes 141 forming two individual electrode rows 150 is larger than an interval (L2) in the scanning direction of the wide-width portions 142 of the individual electrodes 141 forming two individual electrode rows 150 in which the narrow-width portions 143 thereof do not face each other in the scanning direction. Note that an interval (L3) in the scanning direction between the wide-width portions 142 of the individual electrodes 141 forming the sixth individual electrode row 150 and the seventh individual electrode row 150 from the left is further larger than the interval L1 and the interval L2. This is because the first to the sixth individual electrode rows 150 from the left correspond to the pressure chamber rows 25 for color inks, whereas the seventh to the twelfth individual electrode rows 150 from the left correspond to the pressure chamber rows 25 for black ink.

A dummy electrode row 170, constructed of dummy electrodes 171 that are aligned in the conveyance direction at the arrangement pitch P same as that for the individual electrodes 141, is formed between the sixth individual electrode row 150 from the left and the seventh individual electrode row 150 from the left in the scanning direction. The dummy electrodes 171 are formed to correspond to the wide-width portions 142 of the individual electrodes 141, and have the shape and size that are substantially same as those of the wide-width portions 142 of the individual electrodes 141. Note that since the driver IC 52 does not apply the potential to the dummy electrodes 171, the dummy electrodes 171 are not provided with portions corresponding to the narrow-width portions 143 of the individual electrodes 141. The extent of the interval in the scanning direction between the wide-width portion 142 of each of the individual electrodes 141 forming the sixth individual electrode row 150 from the left and one of the dummy electrodes 171, and the extent of the interval in the scanning direction between the wide-width portion 142 of each of the individual electrodes 141 forming the seventh individual electrode row 150 from the left and one of the dummy electrodes 171 are both made to be the interval L1.

The individual electrodes 141, the dummy electrodes 171, the conductor films 180L, 180R, and 180U formed on the upper surface of upper piezoelectric layer 140 can be formed through screen printing. Those can be formed by printing through the same step using the same conductive material. Alternatively, those can be formed by printing through different steps.

<Intermediate Common Electrodes 241>

Figure 6:
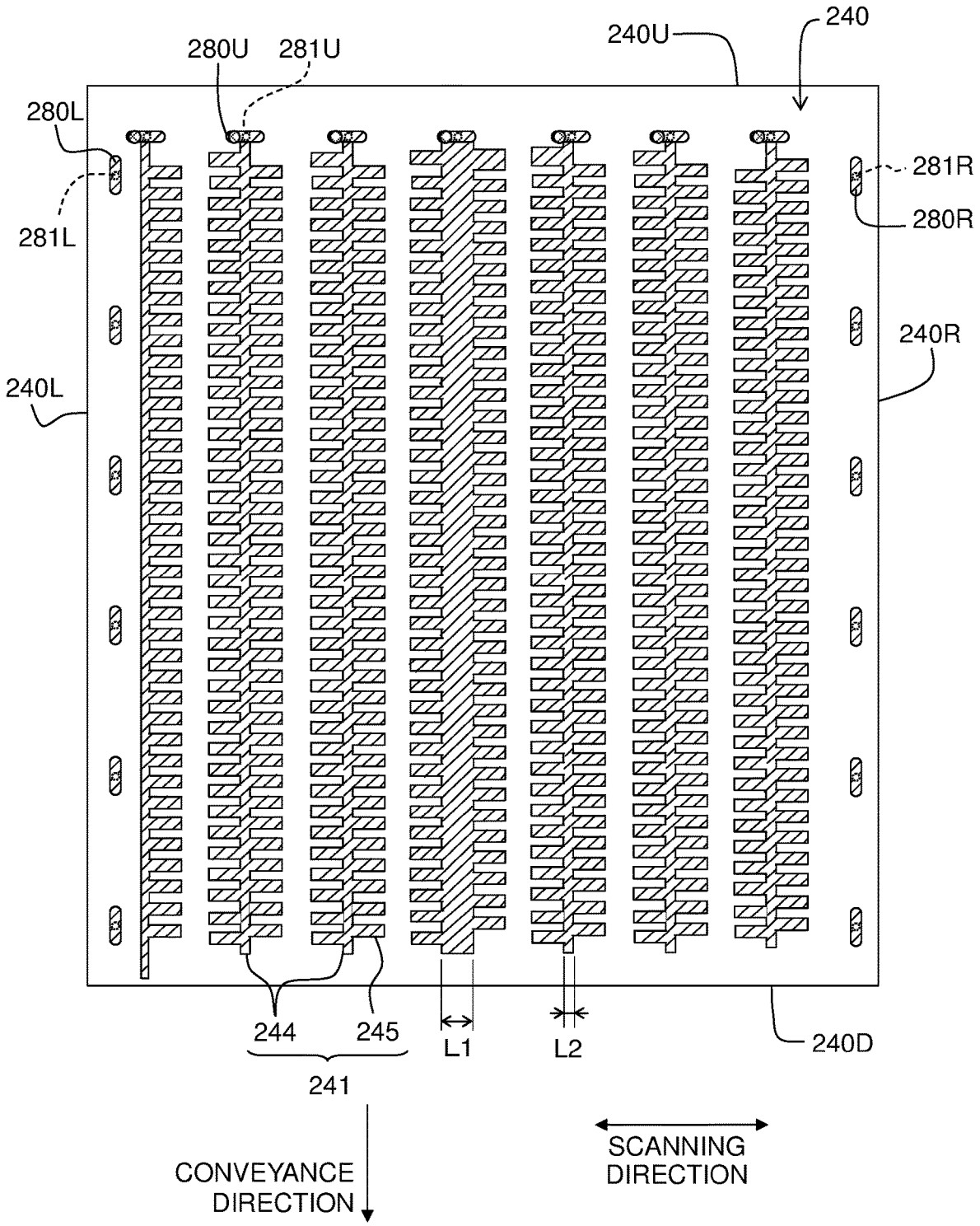
FIG. 6 is a top view of an intermediate piezoelectric layer 240 according to this embodiment.

As depicted in FIGS. 4A and 4B, the seven intermediate common electrodes 241 are formed on the upper surface of the intermediate piezoelectric layer 240. As depicted in FIG. 6, each intermediate common electrode 241 has the extending portion 244 extending in the conveyance direction and protrusions 245 protruding in the scanning direction from the extending portion 244. In the extending portion 244 of each of the second to the seventh intermediate common electrodes 241 from the left, the protrusions 245 protrude from the extending portion 244 at both sides in the scanning direction. In the extending portion 244 of the first intermediate common electrode 241 from the left, the protrusions 245 protrude in the scanning direction from the extending portion 244 toward the end 240R of the intermediate piezoelectric layer 240. In the following explanation, the extending portion 244 of the n-th intermediate common electrode 241 from the left is simply referred to as the n-th extending portion 244 from the left.

Figure 8A:
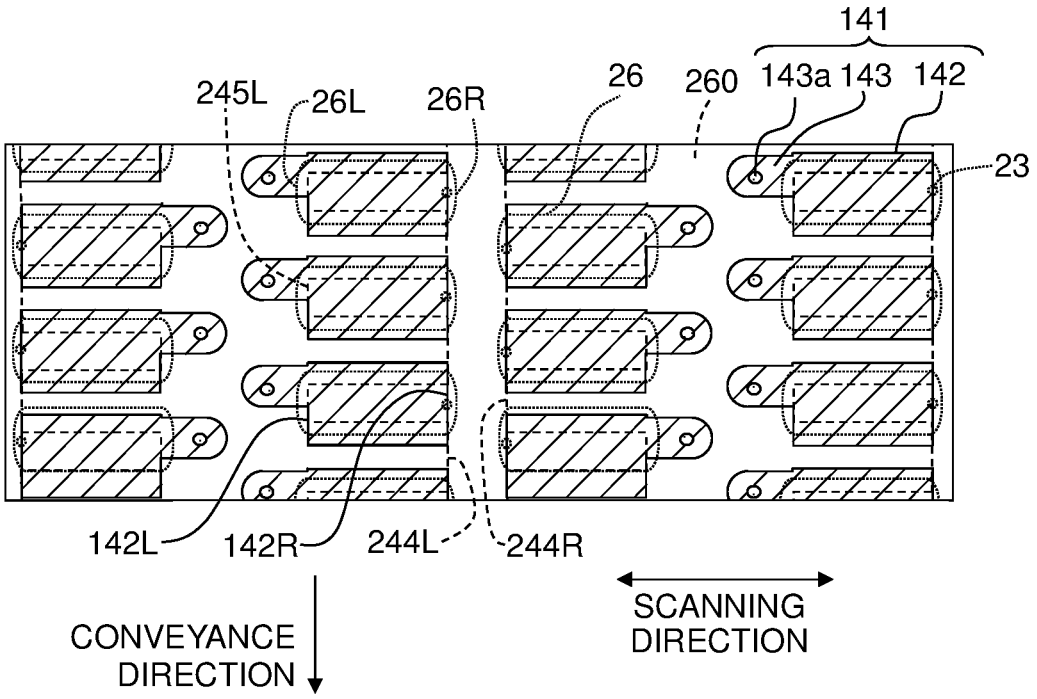
FIG. 8A schematically depicts a state where the upper piezoelectric layer 140 and the intermediate piezoelectric layer 240 according to this embodiment overlap with each other, and FIG. 8B schematically depicts a state where the upper piezoelectric layer 140 and the lower piezoelectric layer 340 according to this embodiment overlap with each other.

As depicted in FIG. 8A, the extending portions 244 extend in the conveyance direction between the wide-width portions 142 of the individual electrodes 141, forming two individual electrode rows 150 that are adjacent in the scanning direction, such that the extending portions 244 do not overlap in the stacking direction with the wide-width portions 142 of the individual electrodes 141 forming the two adjacent individual electrode rows 150. Among the seven extending portions 244 depicted in FIG. 6, the second extending portion 244 from the left extends in the conveyance direction to pass through between, in the scanning direction, the wide-width portions 142 forming the second and third individual electrode rows 150 from the left. The third extending portion 244 from the left extends in the conveyance direction to pass through between, in the scanning direction, the wide-width portions 142 forming the fourth and fifth individual electrode rows 150 from the left. The fourth extending portion 244 from the left extends in the conveyance direction to pass through between, in the scanning direction, the wide-width portions 142 forming the sixth individual electrode row 150 from the left and the dummy electrodes 171 forming the dummy electrode row 170. The fifth extending portion 244 from the left extends in the conveyance direction to pass through between, in the scanning direction, the wide-width portions 142 forming the seventh and eighth individual electrode rows 150 from the left. The sixth extending portion 244 from the left extends in the conveyance direction to pass through between, in the scanning direction, the wide-width portions 142 forming the ninth and tenth individual electrode rows 150 from the left. The seventh extending portion 244 from the left extends in the conveyance direction to pass through between, in the scanning direction, the wide-width portions 142 forming the eleventh and twelfth individual electrode rows 150 from the left.

The fourth extending portion 244 from the left is positioned at a boundary between the pressure chamber rows 25 for color inks and the pressure chamber rows 25 for black ink. The width of the fourth extending portion 244 from the left is L1 (see FIG. 6). At the boundary between the pressure chamber rows 25 for color inks and the pressure chamber row 25 for black ink, the width of the fourth extending portion 244 from the left is wider than the width of the remaining six extending portions 244 in accordance with the wider interval between the pressure chamber rows 25 in the scanning direction. The remaining six extending portions 244 have the same width. Note that with respect to the second, third, fifth, sixth, and seventh extending portions 244 from the left, the individual electrodes 141 forming the two adjacent individual electrode rows 150 that interpose each of the extending portions 244 in the scanning direction are arranged such that the wide-width portions 142 face each other in the scanning direction. The interval or spacing distance in the scanning direction of the two wide-width portions 142 is L2 (see FIG. 5). Thus, in accordance with this configuration, the width in the scanning direction of the five extending portions 244 is also L2 (see FIG. 6). In the present specification, a width in a predefined direction does not mean a width at a certain point, but means an average value or a mean value in an orthogonal direction orthogonal to the predefined direction.

Next, referring to FIG. 8A, an explanation will be made about the positional relationship among the pressure chambers 26, the individual electrodes 141 and the intermediate common electrodes 241. In FIG. 8A, although four individual electrode rows arranged side by side in the scanning direction are depicted, the explanation regarding FIG. 8A will be made about the positional relationship while considering, as an example, the individual electrodes 141 included in the second individual electrode row from the left, and the pressure chambers 26 and intermediate common electrodes 241 overlapping therewith in the stacking direction.

The length in the scanning direction of the pressure chambers 26 is greater (longer) than the length in the scanning direction of the wide-width portions 142 of the individual electrodes 141. Note that the entire length, in the scanning direction, of each of the individual electrodes 141 combining the wide-width portion 142 and the narrow-width portion 143 is greater than the length in the scanning direction of one of the pressure chambers 26. The length in the scanning direction of the protrusions 245 of the intermediate common electrodes 241 is substantially same as the length in the scanning direction of the wide-width portions 142 of the individual electrodes 141.

Each of the nozzles 23 is positioned closer, in the scanning direction, to an end 26R than to an end 26L in the scanning direction of one of the pressure chambers 26. The end 26R of each of the pressure chambers 26 is positioned, in the scanning direction, between an end 244L and an end 244R in the scanning direction of one of the extending portions 244. The end 26L of each of the pressure chambers 26 is positioned, in the scanning direction, between the end 142L of the wide-width portion 142 and an end 143L in the scanning direction of the narrow-width portion 143 of one of the individual electrodes 141. An end 245L in the scanning direction of each of the protrusions 245 of the intermediate common electrodes 241 is arranged at a substantially same position in the scanning direction as the end 142L of the wide-width portion 142 of one of the individual electrodes 141. An end 141R in the scanning direction of the wide-width portion 142 of each of the individual electrodes 141, the end 244L of each of the extending portions 244, and each of the nozzles 23 are arranged at a substantially same position in the scanning direction.

Each of the protrusions 245 of the intermediate common electrodes 241, each of the pressure chambers 26, and the wide-width portion 142 of each of the individual electrodes 141 are arranged such that the center positions thereof in the conveyance direction are substantially aligned with one another in the conveyance direction. The length in the conveyance direction of each of the pressure chambers 26 is greater in the conveyance direction than the length in the conveyance direction of one of the protrusions 245 of the intermediate common electrodes 241; the ratio between the above-described lengths is approximately 2:1. Therefore, the both ends in the conveyance direction of each of the pressure chambers 26 (approximately ¼ of the length in the conveyance direction of each of the pressure chambers 26) do not overlap, in the stacking direction, with the protrusions 245 of the intermediate common electrodes 241. Further, the length in the conveyance direction of the wide-width portion 142 of each of the individual electrodes 141 is greater than the length in the conveyance direction of one of the pressure chambers 26.

<Conductor Film 280L>

Figure 9:
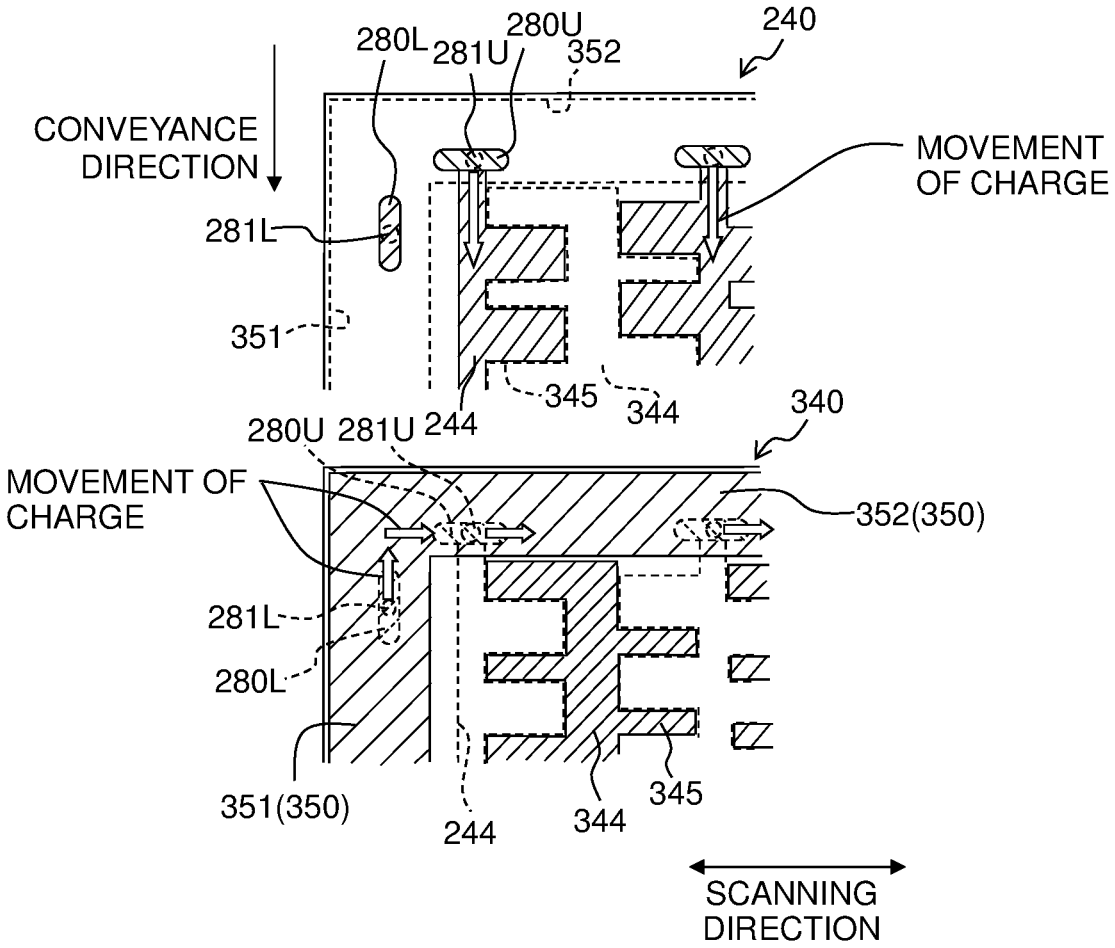
FIG. 9 is a partially enlarged view of the intermediate piezoelectric layer 240 and the lower piezoelectric layer 340 for illustrating a conductor film 350 according to this embodiment.

As depicted in FIGS. 6 and 9, six conductor films 280L are formed in the end 240L in the scanning direction of the intermediate piezoelectric layer 240 at positions overlapping in the stacking direction with the six conductor films 180L. Through holes 281L are formed in the respective conductor films 280L at positions overlapping in the stacking direction with the through holes 181L. The inside of each through hole 281L is filled with the same conductive material as a conductive material forming the conductor films 280L. The conductive material filled in the through holes 281L is electrically conducted with the conductive material filled in the through holes 181L.

<Conductor Film 280U>

As depicted in FIGS. 6 and 9, seven conductor films 280U are formed in the end 240U in the conveyance direction of the intermediate piezoelectric layer 240 at positions overlapping in the stacking direction with the seven conductor films 180U. Through holes 281U are formed in the respective conductor films 280U at positions overlapping in the stacking direction with the through holes 181U. The inside of each through hole 281U is filled with the same conductive material as a conductive material forming the conductor films 280U. The conductive material filled in the the through holes 281U is electrically conducted with the conductive material filled in the through holes 181U. The positions in the scanning direction of the seven conductor films 280U are the same as the positions in the scanning direction of the seven extending portions 244 of the intermediate common electrodes 241. The seven conductor films 280U are electrically conducted with the respective seven extending portions 244 of the intermediate common electrodes 241.

<Conductor Film 280R>

As depicted in FIG. 6, six conductor films 280R are formed in the end 240R in the scanning direction of the intermediate piezoelectric layer 240 at positions overlapping in the stacking direction with the six conductor films 180R. Through holes 281R are formed in the respective conductor films 280R at positions overlapping in the stacking direction with the through holes 181R. The inside of each through hole 281R is filled with the same conductive material as a conductive material forming the conductor films 280R. The conductive material filled in the through holes 281R is electrically conducted with the conductive material filled in the through holes 181R.

The seven intermediate common electrodes 241 and the conductor films 280L, 280R, and 280U formed on the upper surface of the intermediate piezoelectric layer 240 can be formed through screen printing. Those can be formed by printing through the same step using the same conductive material. Alternatively, those can be formed by printing through different steps.

<Lower Common Electrode 341>

Figure 7:
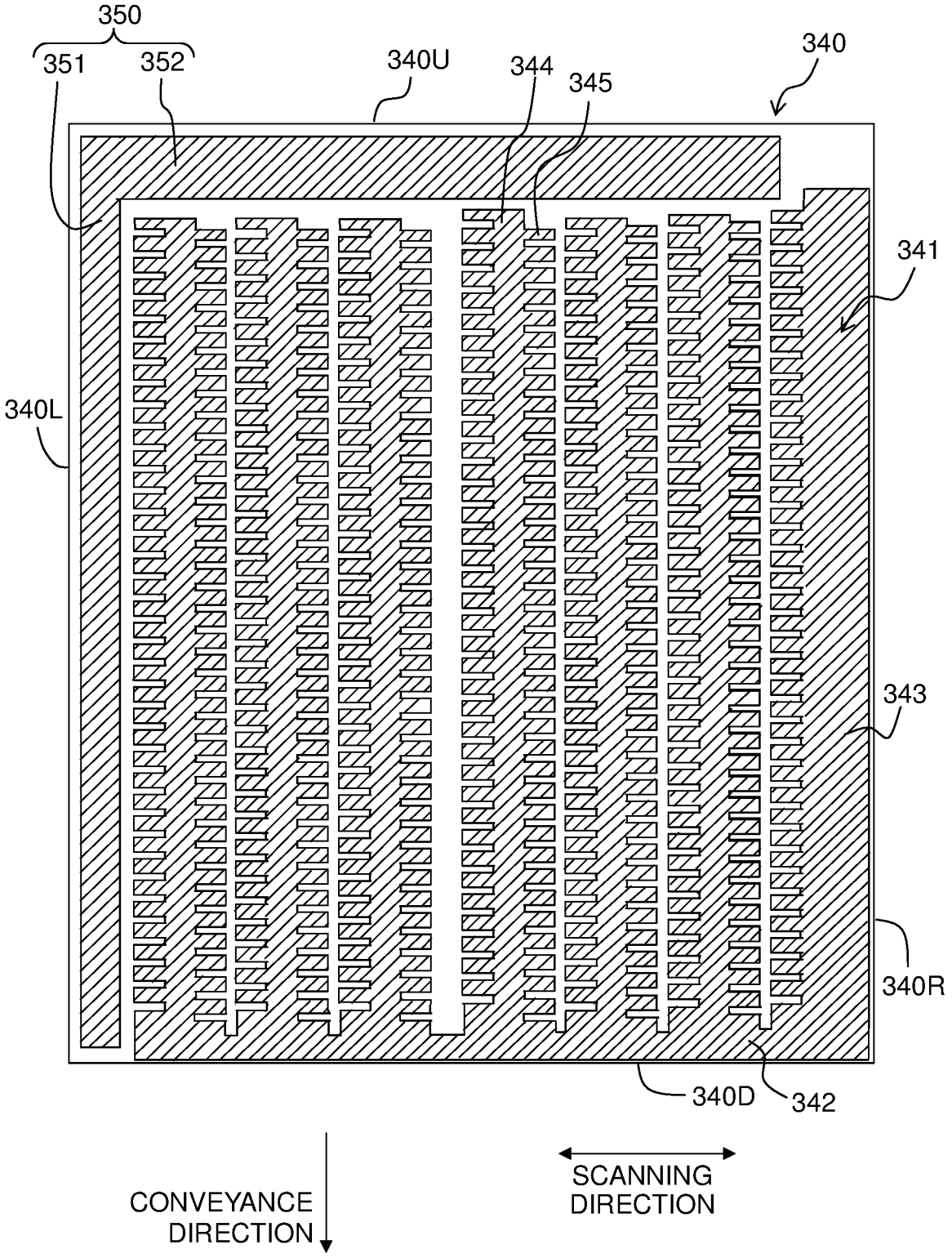
FIG. 7 is a top view of a lower piezoelectric layer 340 according to this embodiment.

As depicted in FIG. 4, the lower common electrode 341 is formed on an upper surface of the lower piezoelectric layer 340. As depicted in FIG. 7, the lower common electrode 341 has an extending portion 342 extending in the scanning direction (the left-right direction) to cover the end 340D in the conveyance direction of the lower piezoelectric layer 340, an extending portion 343 extending in the conveyance direction to cover the end 340R in the scanning direction of the lower piezoelectric layer 340, six extending portions 344 extending in the conveyance direction from the extending portion 342 toward the end 340U in the conveyance direction of the lower piezoelectric layer 340, and protrusions 345 protruding from each of the extending portions 344 toward both sides in the scanning direction. Further, the protrusions 345 protrude from the extending portion 343 toward the end 340L in the scanning direction of the lower piezoelectric layer 340. Note that the extending portion 342 is arranged in a position at which the extending portion 342 does not overlap, in the stacking direction, with the pressure chambers 26 and the individual electrodes 141. Further, the extending portion 342 also does not overlap, in the stacking direction, with the intermediate common electrodes 241.

Each of the six extending portions 344 extends in the conveyance direction between the wide-width portions 142 of the individual electrodes 141, forming two individual electrode rows 150 that are adjacent in the scanning direction, such that each of the extending portions 344 does not overlap, in the stacking direction, with the wide-width portions 142 of the individual electrodes 141 forming the two adjacent individual electrode rows 150. In FIG. 7, among the six extending portions 344, the first extending portion 244 from the left extends in the conveyance direction to pass through between, in the scanning direction, the wide-width portions 142 forming the first and second individual electrode rows 150 from the left. The second extending portion 344 from the left extends in the conveyance direction to pass through between, in the scanning direction, the wide-width portions 142 forming the third and fourth individual electrode rows 150 from the left. The third extending portion 244 from the left extends in the conveyance direction to pass through between, in the scanning direction, the wide-width portions 142 forming the fifth and sixth individual electrode rows 150 from the left. The fourth extending portion 244 from the left extends in the conveyance direction to pass through between, in the scanning direction, the dummy electrodes 171 forming the dummy electrode row 170 and the wide-width portions 142 forming the seventh individual electrode row 150 from the left. The fifth extending portion 344 from the left extends in the conveyance direction to pass through, in the scanning direction, between the wide-width portions 142 forming the eighth and ninth individual electrode rows 150 from the left. The sixth extending portion 344 from the left extends in the conveyance direction to pass through between, in the scanning direction, the wide-width portions 142 forming the tenth and eleventh individual electrode rows 150 from the left.

The fourth extending portion 344 from the left is positioned at the boundary between the pressure chamber rows 25 for color inks and the pressure chamber rows 25 for black ink. The six extending portions 344 have the same width. With respect to the five remaining extending portions 344 that are different from the fourth extending portion 344 from the left, the individual electrodes 141 forming the two adjacent individual electrode rows 150 that interpose each of the five remaining extending portion 344 in the scanning direction are arranged such that the narrow-width portions 143 belonging to the two individual electrode rows 150 face one another in the scanning direction (see FIG. 5). That is, with respect to the five remaining extending portions 344 that are different from the fourth extending portion 344 from the left, the interval or spacing distance in the scanning direction of the wide-width portions 142 of the individual electrodes 141, forming the two adjacent individual electrode rows 150 interposing each of the five remaining extending portion 344 in the scanning direction, is L1. The interval or spacing distance in the scanning direction between the dummy electrodes 171 forming the dummy electrode row 170 and the wide-width portions 142 of the individual electrodes 141, forming the seventh individual electrode row 150 from the left, which interpose the fourth extending portion 344 from the left therebetween in the scanning direction, is also L1. In accordance with this, the width of the six extending portions 344 in the scanning direction is also made to be L1 (see FIG. 7).

Figure 8B:
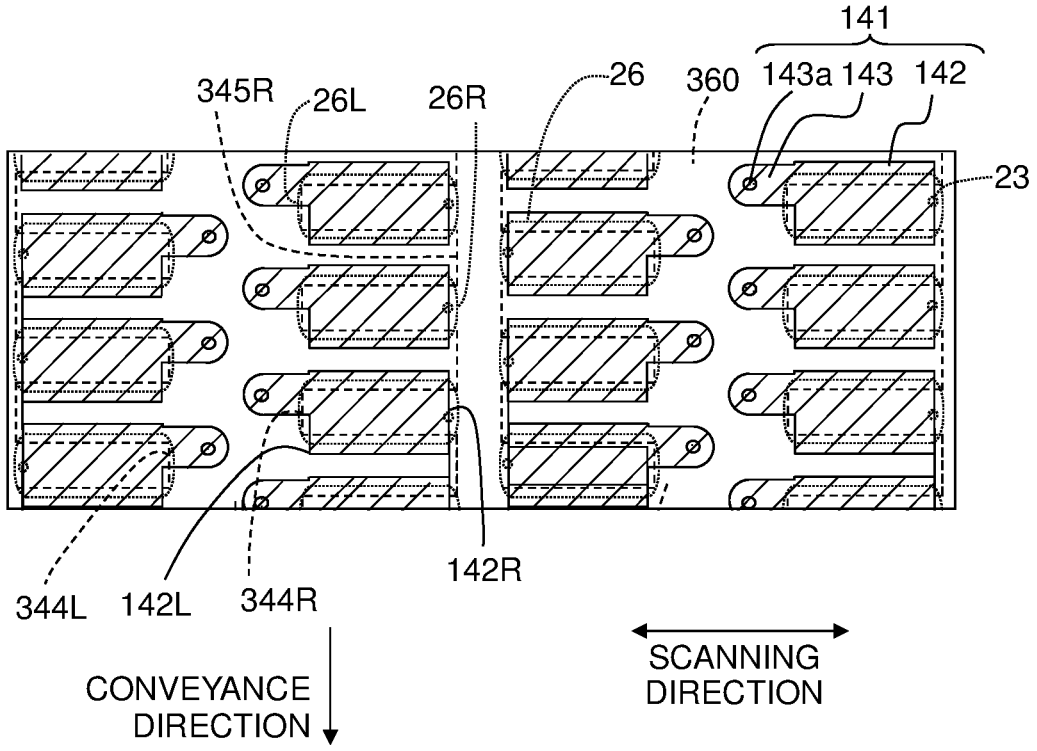

Next, referring to FIG. 8B, an explanation will be made about the positional relationship among the pressure chambers 26, the individual electrodes 141, and the lower common electrode 341. In FIG. 8B, although the four individual electrode rows arranged side by side in the scanning direction are depicted, the explanation regarding FIG. 8B will be made about the positional relationship while considering, as an example, the individual electrodes 141 included in the second individual electrode row from the left, and the pressure chambers 26 and lower common electrode 341 overlapping therewith in the stacking direction.

The length in the scanning direction of the protrusions 345 of the lower common electrode 341 is substantially same as the length in the scanning direction of the wide-width portions 142 of the individual electrodes 141.

The end 26L of each of the pressure chambers 26 is positioned, in the scanning direction, between an end 344L and an end 344R in the scanning direction of one of the extending portions 344. The end 26R of each of the pressure chambers 26 is arranged at a substantially same position in the scanning direction as an end 345R in the scanning direction of one of the protrusions 345 of the lower common electrode 341. The end 344R of each of the extending portions 344 of the lower common electrode 341 is positioned, in the scanning direction, between the end 26L of one of the pressure chambers 26 and the end 142L of the wide-width portion 142 of one of the individual electrodes 141.

Further, as described above, the end 142L of each of the wide-width portions 142 is arranged at a substantially same position in the scanning direction as the end 245L in the scanning direction of one of the protrusions 245 of each of the intermediate common electrodes 241 (see FIG. 8A). Therefore, it is appreciated that each of the protrusions 245 of each of the intermediate common electrodes 241 does not overlap, in the stacking direction, with one of the extending portions 344 of the lower common electrode 341. Further, the end 244L of each of the extending portions 244 of each of the intermediate common electrodes 241 is arranged at a substantially same position in the scanning direction as one of the nozzles 23 (see FIG. 8A). Therefore, it is appreciated that each of the protrusions 345 of the lower common electrode 341 overlaps, in the scanning direction, with one of the extending portions 244 of each of the intermediate common electrodes 241.

The center position, in the conveyance direction, of each of the protrusions 345 of the lower common electrode 341 is substantially aligned (coincident) with the center position in the interval (spacing distance) between two pressure chambers 26 that are included in the pressure chambers 26 and that are adjacent in the conveyance direction. The interval between the two pressure chambers 26 adjacent to each other in the conveyance direction is shorter than the length in the conveyance direction of each of the protrusions 345 of the lower common electrode 341. Therefore, the both ends in the conveyance direction of each of the pressure chambers 26 overlap, in the stacking direction, with the protrusions 345 of the lower common electrode 341. Note that the length in the conveyance direction of overlapping portions in the stacking direction between each of the pressure chambers 26 and the protrusions 345 of the lower common electrode 341 is shorter than ¼ the length in the conveyance direction of each of the pressure chambers 26. As described above, at the both ends in the conveyance direction of the pressure chambers 26, a portion that is about ¼ the length in the conveyance direction of each of the pressure chambers 26 does not overlap, in the stacking direction, with one of the protrusions 245 of each of the intermediate common electrodes 241. Therefore, the protrusions 345 of the lower common electrode 341 do not overlap, in the stacking direction, with the protrusions 245 of each of the intermediate common electrodes 241.

Note that as described above, the center position, in the conveyance direction, of each of the pressure chambers 26 is substantially coincident with the center position in the conveyance direction of the wide-width portion 142 of one of the individual electrodes 141; and the length in the conveyance direction of the wide-width portion 142 of each of the individual electrodes 141 is greater than the length in the conveyance direction of one of the pressure chambers 26. Therefore, the both ends in the conveyance direction of each of the wide-width portions 142 overlap, in the stacking direction, with the protrusions 345 of the lower common electrode 341. The length in the conveyance direction of the overlapped portions in the stacking direction between each of the wide-width portions 142 and the protrusions 345 of the lower common electrode 341 is greater than length in the conveyance direction of the overlapped portions in the stacking direction between each of the pressure chambers 26 and the protrusions 345 of the lower common electrode 341.

<Conductor Film 350>

As depicted in FIGS. 7 and 9, the lower piezoelectric layer 340 is formed having the conductor film 350. The conductor film 350 is part of a trace of the present disclosure. The conductor film 350 has an extending portion 351 that extends in the conveyance direction at the end 340L of the lower piezoelectric layer 340; and an extending portion 352 that extends in the scanning direction from the extending portion 351 toward the end 340R at the end 340U of the lower piezoelectric layer 340.

The extending portion 351 overlaps in the stacking direction with the conductor films 180L and the through holes 181L of the upper piezoelectric layer 140. As depicted in FIG. 9, the extending portion 351 overlaps in the stacking direction with the conductor films 280L and the through holes 281L of the intermediate piezoelectric layer 240. The extending portion 352 overlaps in the stacking direction with the conductor films 180U and the through holes 181U of the upper piezoelectric layer 140. The extending portion 352 overlaps in the stacking direction with the conductor films 280U and the through holes 281U of the intermediate piezoelectric layer 240. The extending portion 351 is coupled with the extending portion 352 at a corner formed by the end 340L and the end 340U of the lower piezoelectric layer 340.

The extending portion 351 is electrically conducted with the conductor films 180L and the terminals 182L of the upper piezoelectric layer 140 through the conductive material filled in the through holes 181L and 281L. The extending portion 352 is electrically conducted with the conductor films 180U and the terminals 182U of the upper piezoelectric layer 140 through the conductive material filled in the through holes 181U and 281U. The extending portion 352 is electrically conducted with the conductor films 280U of the intermediate piezoelectric layer 240 through the conductive material filled in the through holes 281U. As described above, the seven conductor films 280U are electrically conducted with the respective extending portions 244 of the seven intermediate common electrodes 241.

Thus, the six conductor films 180L, the six conductor films 280L, the seven conductor films 180U, the seven conductor films 280U, and the extending portions 351 and 352 of the conductor film 350 of the lower piezoelectric layer 340 are electrically conducted with the seven intermediate common electrodes 241 via the conductive material filled in the through holes 181L, 181U, 281L, and 281U. As depicted in FIGS. 6 and 9, the seven intermediate common electrodes 241 are not connected to each other on the surface of the intermediate piezoelectric layer 240. However, as depicted in FIGS. 7 and 9, the seven intermediate common electrodes 241 are connected to each other through the conductor film 350 of the lower piezoelectric layer 340 or the like. Since all of terminals 182L and terminals 182U are electrically connected to all of the intermediate common electrodes 241, electrical charges supplied from the driver IC 52 to the terminals 182L and 182U are distributed to all of the extending portions 244 (see FIG. 9). The six conductor films 180L, the six conductor films 280L, the seven conductor films 180U, the seven conductor films 280U, the extending portions 351 and 352 of the conductor film 350 of the lower piezoelectric layer 340, and the conductive material filled in the through holes 181L, 181U, 281L, and 281U correspond to the trace of the present disclosure.

The lower common electrode 341 and the conductor film 350 formed on the upper surface of the lower piezoelectric layer 340 can be formed through screen printing. Those can be formed by printing through the same step using the same conductive material. Alternatively, those can be formed by printing through different steps.

<Trace Member 50>

As depicted in FIG. 2, the trace member 50 includes the flexible printed circuit (FPC) 51, and the driver IC 52 disposed on the FPC 51. Contact points (not depicted) formed on the flexible printed circuit 51 are electrically connected to bumps 143*a* provided on the narrow-width portions 143 of the respective individual electrodes 141, thereby making it possible to set the potential individually for the respective individual electrodes 141. Further, as described above, the driver IC 52 is capable of setting a predefined constant potential for the intermediate common electrodes 241 and the lower common electrode 341.

<Driving of Piezoelectric Elements 401>

As described earlier on, the piezoelectric body 40 is a plate-like member that has an approximately rectangular shape in a plane view, and that is arranged on the vibration plate 30 to cover the pressure chambers 26 (see FIG. 2, for example). The piezoelectric body 40 is formed having the piezoelectric elements 401 provided to correspond respectively to the pressure chambers 26. In the following, driving of the piezoelectric elements 401 will be explained. Portions (hereinafter referred to as "first active portions 41"; see FIGS. 4A, 4B), of the upper piezoelectric layer 140, each of which is interposed in the stacking direction between one of the individual electrodes 141 and one of the intermediate common electrodes 241 are polarized in the stacking direction. Further, portions (hereinafter referred to as "second active portions 42"; see FIGS. 4A, 4B), of the upper piezoelectric layer 140 and the intermediate piezoelectric layer 240, each of which is interposed in the stacking direction between one of the individual electrodes 141 and the lower common electrode 341 are also polarized in the stacking direction. Here, in a state where the driver IC 52 is powered, a predefined first potential (24V, for example) is applied constantly to each of the intermediate common electrodes 241, whereas a predefined second potential (0V, for example) is applied constantly to the lower common electrode 341. Further, the first potential and the second potential are selectively applied to each of the individual electrodes 141. Specifically, when ink is not to be discharged from a certain pressure chamber 26, among the pressure chambers 26, corresponding to a certain individual electrode 141, the second potential is applied to the certain individual electrode 141. On this occasion, since there is no potential difference between the certain individual electrode 141 and the lower common electrode 341, the second active portion 42 corresponding to the certain individual electrode 141 is not be deformed. However, between the certain individual electrode 141 and the corresponding one of the intermediate common electrodes 241, there is a potential difference (namely, the difference between the first potential and the second potential, 24V in this case). By virtue of this, the first active portion 41 corresponding to the certain individual electrode 141 is deformed to convex downward (toward the pressure chamber 26).

When ink is to be discharged from a certain pressure chamber 26 corresponding to the certain individual electrode 141, the first potential is first applied to the certain individual electrode 141, and the potential applied to the certain individual electrode 141 is then returned to the second potential. Namely, such a pulse voltage signal is applied to the certain individual electrode 141 that allows the potential applied to the certain individual electrode 141 to be increased from the second potential up to the first potential and then to be returned to the second potential after elapse of a predefined time. When the first potential is applied to the certain individual electrode 141, since the potential difference no longer exists between the certain individual electrode 141 and the corresponding one of the intermediate common electrodes 241, the first active portion 41, which has been deformed to be convex downward (toward the pressure chamber 26), starts recovering to the state of no-deformation. In this situation, since the first active portion 41 displaces upward, the volume of the pressure chamber 26 is thereby increased. At this time, there is generated a potential difference (24V in this case) between the certain individual electrode 141 and the lower common electrode 341, which in turn causes the second active portion 42 to be deformed such that a center portion of the pressure chamber 26 is raised upward, thereby enabling the further increase in the volume of the pressure chamber 26. Next, when the potential of the certain individual electrode 141 returns from the first potential to the second potential as described above, the potential difference no longer exists between the certain individual electrode 141 and the lower common electrode 341, as described above. Accordingly, although the second active portion 42 recovers or returns to the original state thereof, the potential difference (24V in this case) from the first potential to the second potential is again generated between the certain individual electrode 141 and the corresponding one of the intermediate common electrodes 241, which in turn causes the first active portion 41 to deform so as to convex downward (toward the pressure chamber 26). In this situation, due to the pressure applied on the pressure chamber 26, the ink inside the pressure chamber 26 is discharged from the nozzle 23 corresponding thereto.

<Regarding Warping Deformation of Piezoelectric Layer>

As depicted in FIG. 5, the metal film such as the individual electrodes 141 is formed on the surface of the upper piezoelectric layer 140. As depicted in FIG. 6, the metal film such as the intermediate common electrodes 241 is formed on the surface of the intermediate piezoelectric layer 240. As depicted in FIG. 7, the metal film such as the lower common electrode 341 is formed on the upper surface of the lower piezoelectric layer 340.

Figure 14:
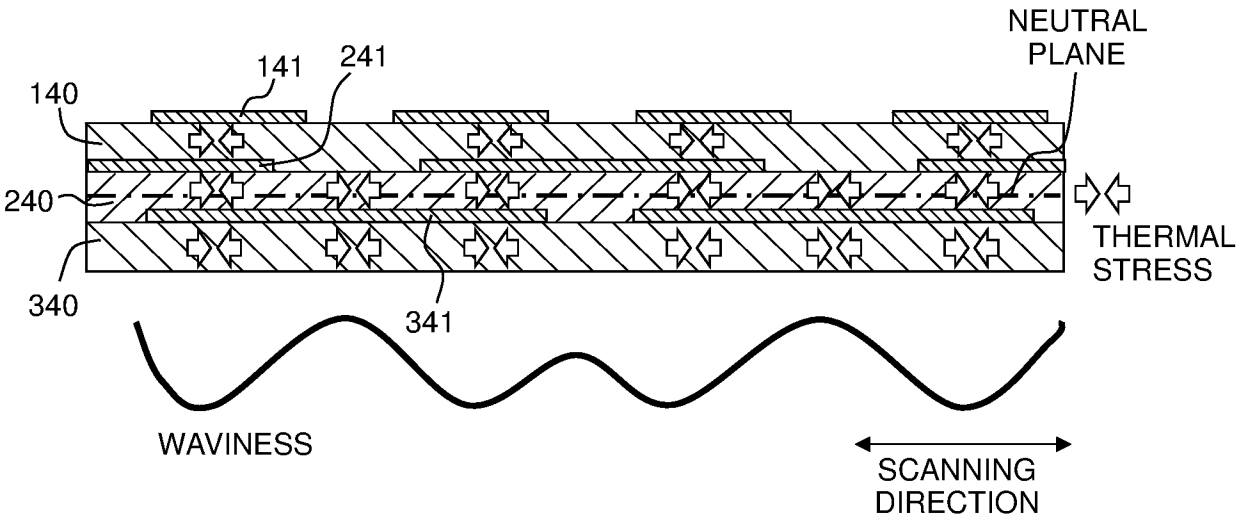
FIG. 14 is a schematic view for illustrating deformation generated in a piezoelectric body.

Generally, in a case of forming the metal film, such as the individual electrodes, the intermediate common electrodes and the lower common electrode, on a surface of the piezoelectric layer, the metal film is formed on a piezoelectric material sheet by performing printing, etc., and then calcination therefor. As depicted in FIG. 14, there is a residual thermal stress in the contraction direction in a calcined piezoelectric layer. In the following explanation, the residual thermal stress in the calcined piezoelectric layer will be simply referred to as the "residual stress". The strength of the residual stress becomes greater as the area of the thin metal film is greater. When there is any difference in the magnitude between an upper residual stress remaining on the upper side and a lower residual stress remaining on the lower side with a neutral plane NP being sandwiched therebetween in the stacking direction, then the piezoelectric body 40 is deformed to warp in the stacking direction, depending on the above-described difference in the magnitude between the upper and lower residual stresses. In this specification, the warp in the stacking direction of the piezoelectric body 40 is referred to as warping deformation.

It is also known that when a sparse portion of the metal film and a dense portion of the metal film are formed on the surface of the piezoelectric layer, a wave-like deformation (waviness) is generated in the calcined piezoelectric layer (see FIG. 13) because the magnitude in the residual stress differs between the sparse and dense portions. In particular, it is considered that when the sparse portion of the metal film and the dense portion of the metal film are arranged side by side in a predefined direction, the waviness of the piezoelectric layer appears remarkably in the predefined direction. In this specification, such a wave-like deformation (waviness) of the piezoelectric layer is distinguished from the above-mentioned warping deformation.

In the stacking direction, when metal films are formed on the upper side and the lower side with the neutral plane NP interposed therebetween, and when the distances in the stacking direction from the respective metal films to the neutral plane NP are substantially the same, whether the piezoelectric body warps upward or downward depends on a magnitude relationship between an area of the metal film on the upper side of the neutral plane NP and an area of the metal film on the lower side of the neutral plane NP. The larger the area of the metal film, the greater residual stress. Therefore, when the area of the metal film on the upper side of the neutral plane NP is larger than the area of the metal film on the lower side of the neutral plane NP, the warping deformation in which the piezoelectric body is convex downward is caused. On the other hand, when the area of the metal film on the lower side of the neutral plane NP is larger than the area of the metal film on the upper side of the neutral plane NP, the warping deformation in which the piezoelectric body is convex upward is caused.

In the stacking direction, when the metal films are formed on the upper side and the lower side with the neutral plane NP interposed therebetween, and when the distances in the stacking direction from the respective metal films to the neutral plane NP differ, whether the piezoelectric body warps upward or downward depends on a magnitude relationship between a product of the area of the metal film on the upper side of the neutral plane NP and the distance in the stacking direction from the neutral plane NP to the metal film on the upper side of the neutral plane NP, and a product of the area of the metal film on the lower side of the neutral plane NP and the distance in the stacking direction from the neutral plane NP to the metal film on the lower side of the neutral plane NP.

In this embodiment, as depicted in FIG. 14, the lower common electrode 341 is provided on the lower side of the neutral plane NP, whereas the intermediate common electrodes 241 and the individual electrodes 141 are provided on the upper side of the neutral plane NP. The distance in the stacking direction between the individual electrodes 141 and the neutral plane NP is longer than the distance in the stacking direction between the intermediate common electrodes 241 and the neutral plane NP and the distance in the stacking direction between the lower common electrode 341 and the neutral plane NP. The sum of the area of the metal film (such as the individual electrodes 141) formed on the surface of the upper piezoelectric layer 140 and the area of the metal film (such as the intermediate common electrodes 241) formed on the surface of the intermediate piezoelectric layer 240 is larger than the area of the metal film (such as the lower common electrode 341) formed on the surface of lower piezoelectric layer 340. Thus, in this embodiment, the warping deformation that is convex downward is caused in the piezoelectric body 40.

In this embodiment, the conductor film 350 formed on the lower piezoelectric layer 340 may be formed on the surface of the intermediate piezoelectric layer 240 to couple the extending portions 244 of the seven intermediate common electrodes 241 with one another. However, in this embodiment, in order to reduce the area of the metal film formed on the surface of intermediate piezoelectric layer 240, the conductor film 350 is formed on the surface of the lower piezoelectric layer 340. This can reduce the area of metal film positioned on the upper side of the neutral plane NP and increase the area of metal film positioned on the lower side of the neutral plane NP. Accordingly, it is possible to reduce the warping deformation in which the piezoelectric body 40 is convex downward as compared with a case in which a portion corresponding to the conductor film 350 is formed on the intermediate piezoelectric layer 240.

<Modified Embodiments>

Figure 10:
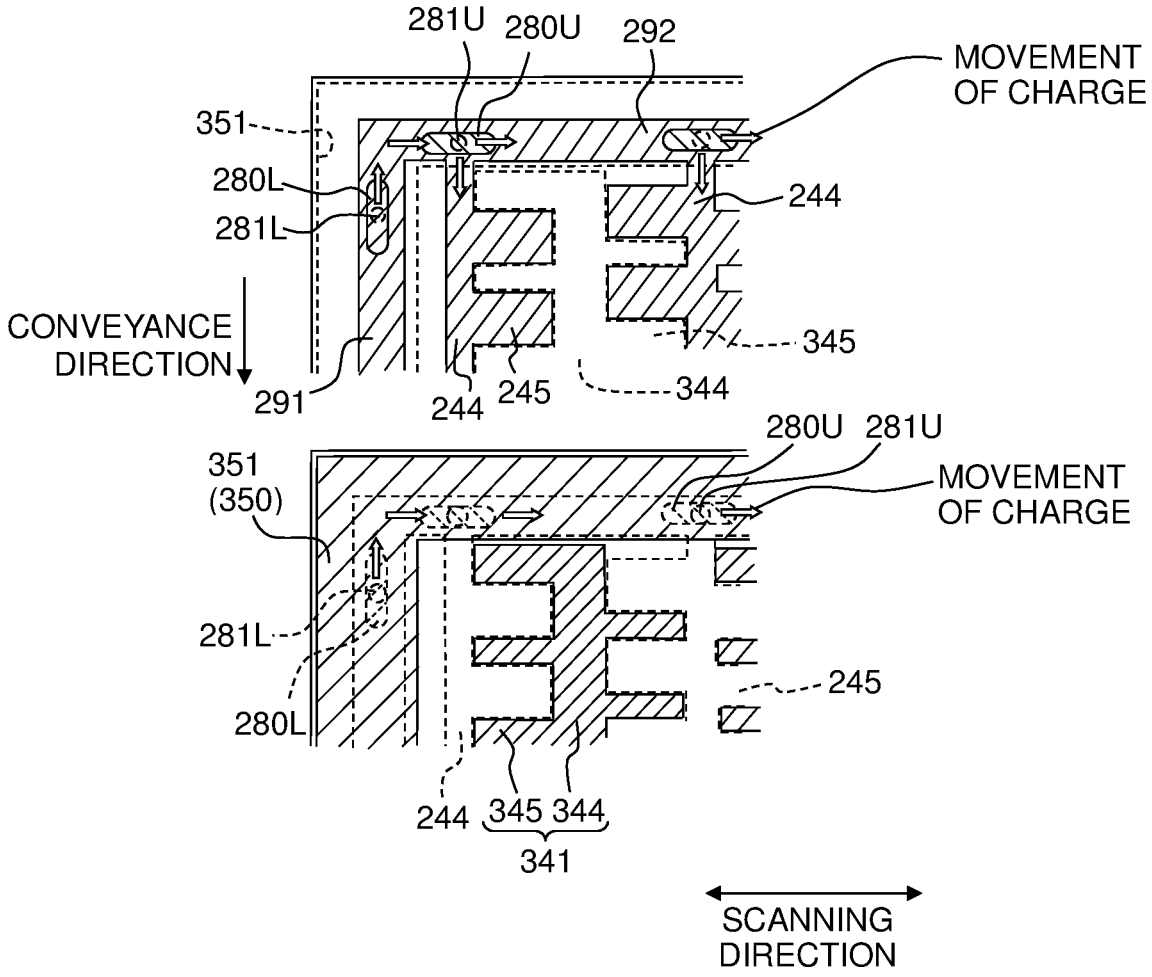
FIG. 10 is a partially enlarged view of the intermediate piezoelectric layer 240 and the lower piezoelectric layer 340 for illustrating the conductor film 350 and extending portions 291 and 292 according to a modified embodiment.

In the above embodiment, the metal film for coupling the extending portions 244 of the seven intermediate common electrodes 241 with one another in the scanning direction is not formed on the upper surface of intermediate piezoelectric layer 240. The present disclosure, however, is not limited to such an aspect. For example, as depicted in FIG. 10, it is possible to form, on the upper surface of the intermediate piezoelectric layer 240, a conductor film 290 that includes an extending portion 291 extending in the conveyance direction to couple the conductor films 280L with one another and an extending portion 292 extending in the scanning direction to couple the conductor films 280U with one another. The conductor film 290 is part of the trace according to the present disclosure. The extending portion 292 couples the extending portions 244 with one another in the scanning direction. In this configuration, since the extending portions 244 are coupled with one another not only by the conductor film 350 but also by the extending portions 291 and 292, the routes for distributing the charges, which are supplied from the driver IC 52 to the terminals 182L and 182U, to the extending portions 244 can be increased. This enhances electrical reliability. Further, as depicted in FIG. 10, the width in the scanning direction of the extending portion 291 is narrower than the width in the scanning direction of the extending portion 351, and the width in the conveyance direction of the extending portion 292 is narrower than the width in the conveyance direction of the extending portion 352. Thus, it is possible to inhibit the area of the metal film formed on the intermediate piezoelectric layer 240 from becoming too large, and to inhibit the warping deformation in which the piezoelectric body 40 is convex downward.

Figure 11:
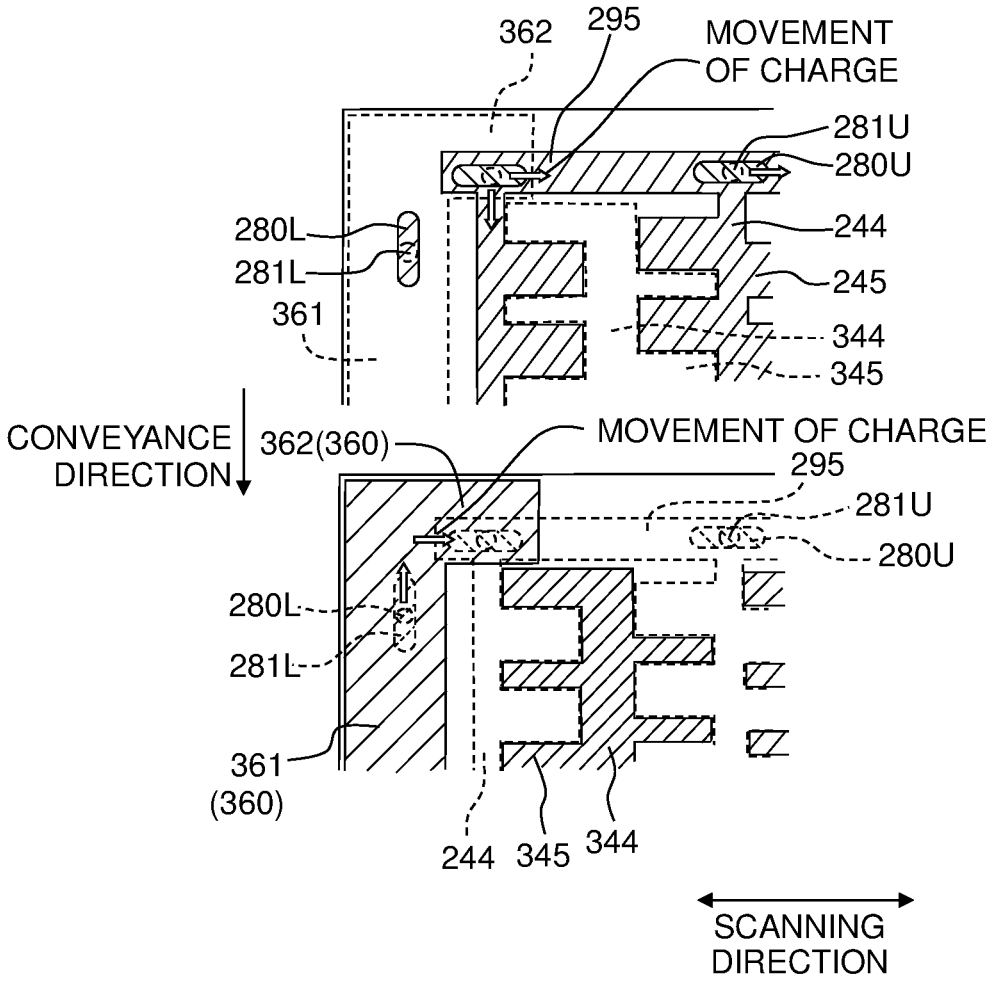
FIG. 11 is a partially enlarged view of the intermediate piezoelectric layer 240 and the lower piezoelectric layer 340 for illustrating a conductor film 360 and an extending portion 295 according to a modified embodiment.

In the above embodiment, the extending portion 352 of the conductor film 350 formed on the upper surface of the lower piezoelectric layer 340 extends in the scanning direction such that the extending portion 352 overlaps in the stacking direction with all the extending portions 244 of the intermediate common electrodes 241. The present disclosure, however, is not limited to such an aspect. For example, as depicted in FIG. 11, a conductor film 360 may include an extending portion 361 extending in the conveyance direction at the end 340L of the lower piezoelectric layer 340 such that the extending portion 361 overlaps in the stacking direction with all of the conductor films 280L, and an extending portion 362 extending in the scanning direction from the extending portion 361 to the end 340R. The length in the scanning direction of the extending portion 362 is shorter than the length in the scanning direction of the extending portion 352 according to the above embodiment. Although the extending portion 362 overlaps in the stacking direction with the conductor film 280U that is closest to the end 340L, the extending portion 362 does not overlap in the stacking direction with the second conductor film 280U numbered from the end 340L. Instead of the length in the scanning direction of the extending portion 362 being shorter than the length in the scanning direction of the extending portion 352 according to the above embodiment, as depicted in FIG. 11, an extending portion 295 extending in the scanning direction to couple all the conductor films 280U with one another is formed on the upper surface of the intermediate piezoelectric layer 240. The width in the conveyance direction of the extending portion 362 is smaller than the width in the conveyance direction of the extending portion 295.

The conductor film 360 is located at a corner formed by the end 340L and the end 340U of the lower piezoelectric layer 340, and the extending portion 361 of the conductor film 360 overlaps in the stacking direction with all the conductor films 280L. The conductor film 360 includes the extending portion 362 that extends from the extending portion 361 to a position that overlaps in the stacking direction with the conductor film 280U closest to the end 340L. Thus, the charges supplied to the terminals 182L can be supplied to the conductor film 280U closest to the end 340L via the conductor film 360. As described above, even when the area of the conductor film 360 is increased, the warping deformation of the piezoelectric body 40 is not increased. Thus, the area of conductor film 360 can be increased, whereby the charges supplied to the terminals 182L can be stably supplied to the conductor film 280U closest to the end 340L. Part of the charges supplied to the conductor film 280U closest to the terminal 340L is supplied to the extending portion 244 connected to the conductor film 280U closest to the terminal 340L, and the remaining charges pass through the extending portion 295 and are supplied to the extending portions 244 away in the scanning direction from the end 340L. Thus, the charges supplied to the conductor film 280U closest to the end 340L are supplied while branching toward the extending portions 244. Therefore, the width in the conveyance direction of the extending portion 295 can be narrower than the width in the conveyance direction of the extending portion 362. This makes it possible to reduce the area of the metal film formed on the upper surface of the intermediate piezoelectric layer 240 and to reduce the warping deformation of the piezoelectric body 40, as compared with a case in which the width in the conveyance direction of the extending portion 295 is equal to the width in the conveyance direction of the extending portion 362.

Figure 12:
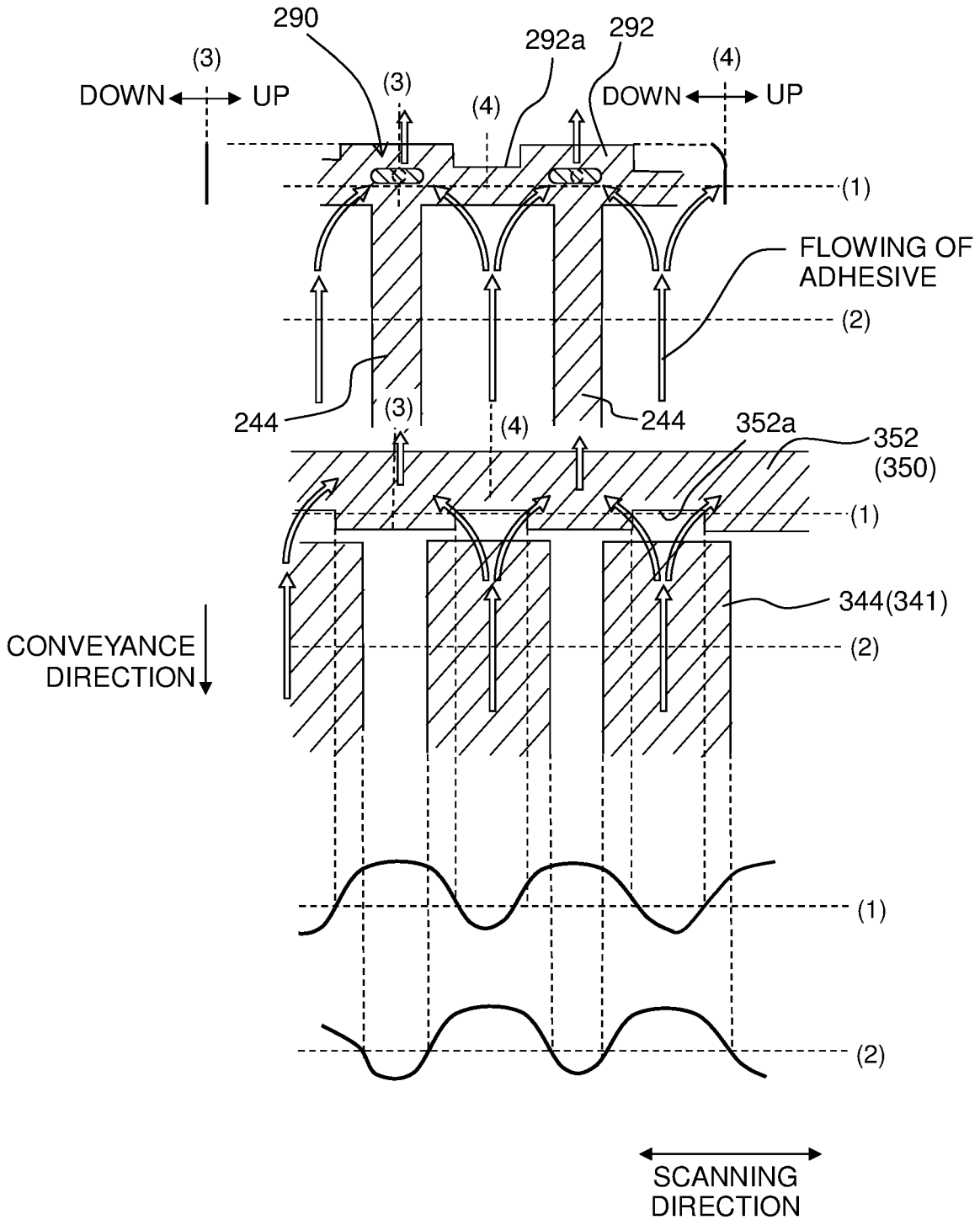
FIG. 12 is a partially enlarged view of the intermediate piezoelectric layer 240 and the lower piezoelectric layer 340 for illustrating cutouts (notches) 352*a* of an extending portion 352 and cutouts (notches) 292*a* of the extending portion 292 according to a modified embodiment.

In the above embodiment and modified embodiments, the extending portion 352 of the conductor film 350 and the extending portion 292 of the intermediate common electrodes 241 each are a rectangle extending in the scanning direction. However, as depicted in FIG. 12, cutouts (notches) 352*a* and 292*a* may be formed in the extending portion 352 and the extending portion 292, respectively. An upper side of FIG. 12 depicts part of the extending portions 244 and 292 of the intermediate common electrodes 241 formed on the intermediate piezoelectric layer 240, and a lower side of FIG. 12 depicts part of the extending portions 344 of the lower common electrode 341 and part of the extending portion 352 of the conductor film 350 formed on lower piezoelectric layer 340. As depicted in FIG. 12, the cutouts (notches) 352*a* may be provided in the lower piezoelectric layer 340 at portions of the extending portion 352 of the conductor film 350 facing the extending portions 344 of the lower common electrode 341 in the conveyance direction. Further, the cutouts (notches) 292*a* may be formed in the intermediate piezoelectric layer 240 at the positions, of the extending portion 292 of the conductor film 290, identical to the notches 352*a* in the scanning direction. The cutouts (notches) 292*a* are notched from the upper side to the lower side in FIG. 12.

As described above, when the sparse portion of the metal film and the dense portion of the metal film are arranged side by side in the predefined direction on the surface of the piezoelectric layer, the waviness of the piezoelectric layer is caused in the predefined direction. FIG. 12 schematically depicts the waviness of the piezoelectric layer in a cross-section taken along each of the dotted lines 1 to 4. In the cross-section taken along the dotted line 1, since the portions included in the lower common electrode 341 and formed having the extending portions 344 correspond to the dense portions of the metal film, waviness is caused such that the portions are convex upward. On the other hand, in the cross section taken along the dotted line 2, since the portions included in the extending portion 352 of the conductor film 350 and formed having the notches 352*a* correspond to the sparse portions of the metal film, waviness is caused such that the portions are convex upward.

Next, deformation of the piezoelectric body 40 in the cross-section taken along the dotted line 3 is compared with deformation of the piezoelectric body 40 in the cross-section taken along the dotted line 4. The dotted line 3 and 4 extend in the conveyance direction toward an upper end of the piezoelectric body 40. At a free end, such as the ends of the piezoelectric body 40, the metal film that is included in the portions formed having the metal film such as conductor layers and that is positioned on the upper side of the neutral plane attempts to deform the piezoelectric body so that the piezoelectric body becomes convex upward by the residual stress. On the other hand, the metal film that is included in the portions formed having the metal film such as the conductor layers and that is positioned on the lower side of the neutral plane attempts to deform the piezoelectric body so that the piezoelectric body becomes convex downward by the residual stress. As depicted in FIG. 14, the neutral plane is positioned approximately midway between the upper surface of the intermediate piezoelectric layer 240 and the upper surface of the lower piezoelectric layer 340.

In the portion taken along the dotted line 3, the extending portion 352 of the conductor layer 350 is disposed on the upper surface of the lower piezoelectric layer 340, and the extending portion 292 of the conductor layer 290 is disposed on the upper surface of the intermediate piezoelectric layer 240. Since the metal films having substantially the same thickness are formed at positions having substantially an equal distance at both sides of the neutral plane, the deformation by these metal films cancel each other out. Thus, the portion taken along the dotted line 3 is not likely to have deformation. On the other hand, in the portion taken along dotted line 4, although the extending portion 352 of the conductor layer 350 is disposed on the upper surface of lower piezoelectric layer 340, the cutouts (notches) 292*a* are formed in the upper surface of the intermediate piezoelectric layer 240 and the conductor layer 290 is not formed. Since the metal film is unevenly distributed on the lower side of the neutral plane, the piezoelectric body 40 is deformed to be convex downward in the portion taken along the dotted line 4.

It is considered a step of coating the lower surface of piezoelectric body 40 with adhesive and putting the piezoelectric body 40 onto the channel unit 20 on which the vibration plate 30 is put (hereinafter referred to simply as the channel unit 20). In areas of the lower common electrode 341 formed having the extending portions 344, like the cross-section taken along the dotted line in FIG. 12, areas along the extending portions 344 are deformed to be convex upward. Thus, in the lower surface of the piezoelectric body 40, streak-like recesses extending in the conveyance direction are generated along the extending portions 344. In other words, streak-like spaces are formed between the piezoelectric body 40 and the channel unit 20. Excessive adhesive of the adhesive applied to the lower surface of the piezoelectric body 40 can flow along the streak-like recesses. In areas of the extending portion 352 of the conductor film 350 formed having the cutouts (notches) 352*a*, like the cross-section taken along the dotted line in FIG. 12, portions included in the piezoelectric body 40 and formed having the cutouts (notches) 352*a* are deformed to be convex downward, and a portion between two cutouts (notch) 352*a* adjacent to each other in the scanning direction is deformed to be convex upward. Accompanying with this, adhesive flowing along the streak-like recesses is winded to avoid the portions formed having the cutouts (notches) 352*a*, and flows toward the portion between the two cutouts (notches) 352*a* adjacent to each other in the scanning direction. Further, in the conveyance direction, although portions included in the piezoelectric body 40 and formed having no cutouts (notches) 292*a* are substantially flat (see, the cross section taken along the dotted line 3), the portions formed having the cutouts (notches) 292*a* are deformed to be convex downward (see, the cross section taken along the dotted line 4). Adhesive is not likely to flow out of the deformed portions in which the piezoelectric body 40 is deformed to be convex downward. On the other hand, when both of the portions formed having the cutouts (notches) 292*a* and the portions formed having no cutouts (notches) 292*a* are formed as depicted in FIG. 12, the deformation that is convex downward is small in the portions formed having no cutouts (notches) 292*a*. By providing the portions having a large deformation that is convex downward in the scanning direction and the portions having a small deformation that is convex downward in the scanning direction as described above, excessive adhesive can be efficiently discharged from the portions having the small deformation that is convex downward to the outside of the piezoelectric body 40. In FIG. 12, the excessive adhesive flowing toward the portion between the two cutouts (notches) 352*a* adjacent to each other in the scanning direction passes through the portions formed having no cutouts (notches) 292*a* and is discharged to the outside of the piezoelectric body 40. As described above, by forming the cutouts (notches) 352*a* and 292*a* in the extending portions 352 and 292, respectively, the excessive adhesive of the adhesive applied to the lower surface of piezoelectric body 40 can be discharged to the outside of the piezoelectric body 40 by using the spaces that are generated between the piezoelectric body 40 and the channel unit 20 by the waviness of the piezoelectric body 40.

Figure 13:
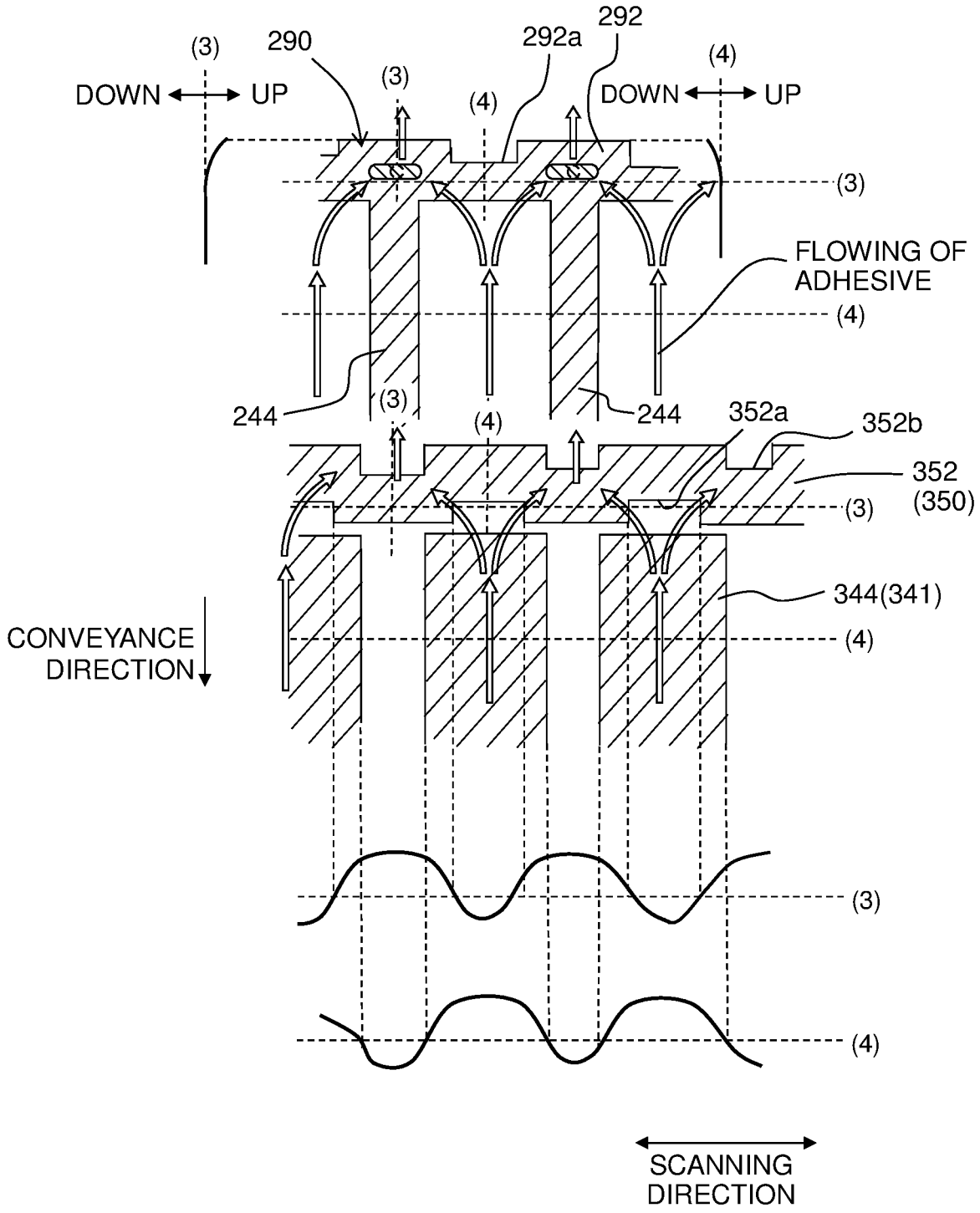
FIG. 13 is a partially enlarged view of the intermediate piezoelectric layer 240 and the lower piezoelectric layer 340 for illustrating cutouts (notches) 352*a* and 352*b* of the extending portion 352 and the cutouts (notches) 292*a* of the extending portion 292 according to a modified embodiment.

Further, as depicted in FIG. 13, in the lower piezoelectric layer 340, cutouts (notches) 352*b* may be provided in the extending portion 352 of the conductor film 350 at portions between the two cutouts (notches) 292*a* adjacent to each other in the scanning direction. The cutouts (notches) 352*b* are notched from the upper side to the lower side in FIG. 13.

In this case, the deformation of the cross-section taken along the dotted line 4 is the same as the case depicted in FIG. 12. However, in the cross-section taken along the dotted line 3, although the extending portion 292 of the conductor layer 290 is disposed on the upper surface of the intermediate piezoelectric layer 240, the cutouts (notches) 352*b* are formed in the upper surface of the lower piezoelectric layer 340 and the conductor layer 350 is not formed. Since the metal film is unevenly distributed on the upper side of the neutral plane, the piezoelectric body 40 is deformed to be convex upward in the portion taken along the dotted line 3. Thus, it is possible to discharge excessive adhesive to the outside of the piezoelectric body 40 more efficiently than the case depicted in FIG. 12. That is, in FIG. 13, the excessive adhesive flowing toward the portion between the two cutouts (notches) 352*a* adjacent to each other in the scanning direction passes through the portions formed having the cutouts (notches) 352*b* (the portions having no cutouts (notches) 292*a*) and is discharged to the outside of the piezoelectric body 40. By forming the cutouts (notches) 352*a*, 352*b*, and 292*a* in the extending portions 352 and 292, respectively as descried above, the excessive adhesive of the adhesive applied to the lower surface of piezoelectric body 40 can be discharged to the outside of the piezoelectric body 40 by using the spaces that are generated between the piezoelectric body 40 and the channel unit 20 by the waviness of the piezoelectric body 40.

In the above embodiment, the piezoelectric body 40 has three piezoelectric layers, and the electrode(s) is/are formed on the upper surface of each piezoelectric layer. The present disclosure, however, is not limited to such an aspect. The piezoelectric body may have three or more piezoelectric layers, and the electrode(s) may be formed on the lower surface of each piezoelectric layer. In the above embodiment, although the piezoelectric element has the two common electrodes (intermediate common electrodes and lower common electrode), the present disclosure is not limited to such an aspect. The piezoelectric element may have only one common electrode. In the above embodiment, the individual electrodes are formed on the uppermost side in the stacking direction, and the common electrodes (intermediate common electrodes and lower common electrode) are provided on the lower side of the individual electrodes. The present disclosure, however, is not limited to such an aspect. For example, the individual electrodes may be formed on the lowermost side in the stacking direction, and the common electrodes may be provided on the upper side thereof. In the above embodiment, although each individual electrode 141 has the wide-width portion 142 and the narrow-width portion 143, the shape of the individual electrode is not necessarily limited to such an aspect. For example, the width in the conveyance direction of the individual electrodes may be uniform in the scanning direction. Further, it is possible to freely set the number of the pressure chambers 26 as well as the arrangement, shape, pitch, and the like of the pressure chambers 26. Corresponding to this setting, it is possible to adjust the number of the individual electrodes as well as the arrangement, shape, pitch, and the like of the individual electrodes.

The embodiment and the modified embodiments described above apply the present disclosure to the ink-jet head 5 configured to print an image, etc., by discharging the ink(s) to the recording paper. In the above embodiment, the ink-jet head 5 is a so-called serial ink-jet (ink discharge) head. However, the present disclosure is not limited to the serial ink-jet head; rather, the present disclosure is applicable also to a so-called line ink-jet head. Further, the present disclosure is not limited to ink-jet heads discharging ink. The present disclosure is also applicable to liquid discharge apparatuses usable in a variety of kinds of usage or application other than printing image, etc. For example, it is possible to apply the present disclosure to a liquid discharge apparatus configured to form a conductive pattern on a surface of a substrate by discharging a conductive liquid onto the substrate.

What is claimed is:

1. A liquid discharge head, comprising:

a piezoelectric body including a plurality of piezoelectric layers stacked in a stacking direction, the piezoelectric body including a first end and a second end that are separated in a first direction, the first direction being orthogonal to the stacking direction of the piezoelectric layers;

a plurality of individual electrodes positioned on a first plane orthogonal to the stacking direction;

a first common electrode positioned on a second plane orthogonal to the stacking direction, a position of the second plane in the stacking direction being different from a position of the first plane in the stacking direction and a position of a neutral plane of the piezoelectric body in the stacking direction; and a trace positioned on a third plane, a position of the third plane in the stacking direction being different from the position of the first plane in the stacking direction, the position of the second plane in the stacking direction, and the position of the neutral plane in the stacking direction, wherein the neutral plane is positioned between the first plane and the third plane in the stacking direction, and the second plane is positioned between the first plane and the third plane in the stacking direction, the piezoelectric body includes at least one through hole passing through from the second plane to the third plane, the individual electrodes are included in a plurality of individual electrode rows arranged between the first end and the second end with an interval therebetween, the individual electrode rows include a first individual electrode row and a second individual electrode row that is adjacent to the first individual electrode row in the first direction, the first individual electrode row being positioned between the first end and the second individual electrode row in the first direction, the individual electrodes included in the first individual electrode row are arranged in a second direction orthogonal to the stacking direction and intersecting with the first direction, the first common electrode includes:

a first extending portion extending, on the second plane, in the second direction to pass through a position between the first individual electrode row and the second individual electrode row in the first direction; and a plurality of first protrusions protruding, on the second plane, from and electrically connected to the first extending portion toward the first end, each of the first protrusions partially overlaps in the stacking direction with one of the individual electrodes belonging to the first individual electrode row, and the first extending portion is electrically conducted with the trace through a conductive material placed inside the at least one through hole.

2. The liquid discharge head according to claim 1, wherein the neutral plane is positioned between the second plane and the third plane in the stacking direction.

3. The liquid discharge head according to claim 1, wherein the individual electrode rows include a third individual electrode row that is adjacent to the second individual electrode row in the first direction, and the second individual electrode row is positioned between the first individual electrode row and the third individual electrode row in the first direction, the first common electrode includes a second extending portion extending, on the second plane, in the second direction to pass through a position between the second individual electrode row and the third individual electrode row in the first direction;

the trace extends, on the third plane, in the first direction between the first extending portion and the second extending portion in the first direction, and the second extending portion is electrically conducted with the trace through the conductive material placed inside the at least one through hole.

4. The liquid discharge head according to claim 3, wherein the first common electrode does not overlap with the trace in the stacking direction.

5. The liquid discharge head according to claim 3, wherein the piezoelectric body includes a third end and a fourth end separated in the second direction, the trace includes, on the second plane, a connecting portion extending in the first direction between the third end and the first extending portion in the first direction and between the third end and the second extending portion in the first direction and connecting the first extending portion and the second extending portion, and at least a part of the trace located on the third plane overlaps in the stacking direction with the connecting portion.

6. The liquid discharge head according to claim 5, wherein a width in the second direction of the part of the trace placed on the third plane is larger than a width in the second direction of the connecting portion.

7. The liquid discharge head according to claim 5, further comprising a second common electrode positioned on the third plane, wherein the second common electrode includes a third extending portion extending in the second direction to pass through a position between the first individual electrode row and the third individual electrode row in the first direction, and a plurality of second protrusions protruding from the third extending portion toward the second end, each of the second protrusions partially overlaps in the stacking direction with one of the individual electrodes belonging to the first individual electrode row, a portion included in the part of the trace placed on the third plane and overlapping in the second direction with the third extending portion is formed having a recess that is recessed from the fourth end toward the third end, and a portion included in the connecting portion of the trace and overlapping in the second direction with the third extending portion is formed having a recess that is recessed from the third end toward the fourth end.

8. The liquid discharge head according to claim 7, further comprising a recess that is recessed from the third end toward the fourth end at a portion included in the part of the trace placed on the third plane and not overlapping in the second direction with the third extending portion.

9. The liquid discharge head according to claim 1, wherein the piezoelectric body includes a third end and a fourth end separated in the second direction, and a part of the trace is placed, on the third plane, at a corner formed by the first end and the third end or a corner formed by the second end and the third end.

* * * * *